US005680084A

United States Patent [19]

Kishi et al.

[11] Patent Number: 5,680,084

[45] Date of Patent: Oct. 21, 1997

[54] SEALED CONTACT DEVICE AND OPERATING MECHANISM

[75] Inventors: Hideki Kishi; Takehiko Toguchi; Takaaki Chuzawa; Riichi Uotome, all of Kadoma, Japan

[73] Assignee: Matsushita Electric Works, Ltd., Osaka, Japan

[21] Appl. No.: 478,659

[22] Filed: Jun. 7, 1995

[30] Foreign Application Priority Data

| | | | |
|---|---|---|---|
| Nov. 28, 1994 | [JP] | Japan | 6-293521 |
| Nov. 28, 1994 | [JP] | Japan | 6-293522 |
| Nov. 28, 1994 | [JP] | Japan | 6-293523 |

[51] Int. Cl.[6] ..... H01H 50/54; H01H 50/64; H01H 1/66; H01H 33/64

[52] U.S. Cl. ..... 335/15; 335/154

[58] Field of Search ..... 218/1, 13, 26; 335/151–154, 185–204

[56] References Cited

U.S. PATENT DOCUMENTS

| | | | |
|---|---|---|---|
| 4,638,275 | 1/1987 | Belbel et al. | 335/151 |
| 4,866,227 | 9/1989 | Toguchi et al. | 218/26 |
| 5,420,555 | 5/1995 | Toguchi et al. | 335/185 |

FOREIGN PATENT DOCUMENTS

| | | | |
|---|---|---|---|
| 6-231648 | 6/1994 | Japan | H01H 1/66 |

*Primary Examiner*—J. R. Scott

*Attorney, Agent, or Firm*—Leydig, Voit & Mayer

[57] ABSTRACT

A sealed contact device includes a sealed contact section having a sealed container defining therein a gas-tight space together with a bellows for housing therein electrodes and sealing therein a gas preferably consisting mainly of hydrogen, the electrodes including fixed electrodes and movable electrodes engageable with and separable from the fixed electrodes, a contact pressure spring biasing the movable electrodes in engaging direction with respect to the fixed electrodes, a resetting spring biasing the movable electrodes in separating direction from the fixed electrodes, and a movable shaft projected at an end out of the sealed container and coupled at the other end to the movable electrodes; a driving member providing at a movable part a drive force for driving the movable shaft in the direction of engaging the electrodes; and a relaying member interposed between the movable shaft of the sealed contact section and the movable part of the driving member and having a regulating element for regulating driving position of the movable shaft, the relaying member being coupled to the movable part and including a coupling element coupled through the regulating element to the movable shaft.

12 Claims, 14 Drawing Sheets

SEALED CONTACT DEVICE AND OPERATING MECHANISM

BACKGROUND OF THE INVENTION

This invention relates to a sealed contact device optimumly utilizable in relays for use with a power load, electromagnetic switches and so on.

DESCRIPTION OF RELATED ART

As a conventional sealed contact device, there has been one of such costruction as disclosed in, for example, Japanese Patent Laid-Open Publication No. 6-231648, in which the sealed contact device comprises a sealed contact section including a sealed container defining therein a gas-tight space together with a bellows for housing therein contacts and hydrogen or a gas consisting mainly of hydrogen. A fixed electrode is provided with a fixed contact, a movable contactor is provided with a movable contact for engaging with and separating from the fixed contact, a contact pressure spring is provided for urging the movable contactor in a direction of engaging the movable contact with the fixed contact, a return spring is provided for urging the movable contactor in a direction of separating the movable contact from the fixed contact, and a movable shaft is projected at one end part out of the sealed container and coupled at the other end part to the movable contactor. A drive member provides a driving force for driving the movable shaft with a movable iron core (movable part) in the direction of engaging the movable contact with the fixed contact; and a relay member including means interposed between the movable shaft and the movable part to relay the driving force of the drive member to the movable shaft for regulating the drive position of the movable shaft.

In the foregoing construction, the drive member is an electromagnetic device which comprises coils wound on a coil bobbin, a movable core made in a columnar shape and securing on one end side a movable shaft, the movable core being movable in the axial direction within an inserting hole of the coil bobbin upon excitation of the coils, a yoke formed to externally enclose the coil bobbin, a yoke plate secured to the yoke, and a fixed core fixed at an end to the center of the yoke plate and provided with an inserting hole for the movable shaft. The electromagnetic device is housed in a housing together with two of the sealed contact sections disposed concurrently.

The foregoing relay member is formed in a planar shape and is pivotably supported by a bar-shaped rotary shaft passed through a shaft hole in one side part, adjacent to the other side part and at two portion on both sides of which there are provided penetrating holes, and regulating pins and regulating nuts constituting the regulating means are mounted through these penetrating holes. These regulating pins and nuts are provided with screw threads to be screwed to one another, and are in positional relationship for engaging at the regulating pins with an end of the movable shafts of the sealed contact section.

Next, the sequence of regulation of the drive position of the movable shaft by the regulating means shall be referred to. First, the movable shaft is rotated up to a prescribed position by means of a jig imitating the driving state of the electromagnetic device, with the relay member made as a rotary fulcrum. Then, the regulating pin is rotated with such tool as a screw driver or the like, so as to be rotated along the screw threads of the regulating nut up to a position where the contacts engage with each other, whereby the movable shaft is pushed to have its drive position regulated.

In the sealed contact device of the foregoing structure, the movable shaft of the electromagnetic device is caused to move in the axial direction of the coil bobbin while being guided along the inserting hole provided in the fixed core, by the drive force produced when the movable core is attracted to the fixed core by the excitation of the coils, so as to push the relay member. At this time, the relay member is rotated about the rotary shaft as the rotary fulcrum, the respective movable shafts of the two sealed contact sections are pushed at their one end by tip ends of the regulating members, and the contacts in the sealed containers are engaged with one another. Further, as the excitation of the coils wanes, the contacts are separated as caused to reset mainly by resetting springs included in the sealed contact sections, and the original state is restored.

In the forgoing conventional sealed contact device, however, it is possible to regulate the drive position of the movable shafts by the regulating means, but the movable shafts are made movable in the contact engaging direction due to the pushing of the relay member and in the contact separating direction mainly due to the resetting force of the resetting spring. Upon occurrence of slight contact welding stronger than the resetting force, and even when the relay member is caused to displace in the contact separating direction to be reset to the original state, the movable shafts coupled to the movable contactors kept secured to the fixed electrode do not displace in the same direction, whereby the contacts slightly welded cannot be separated, and there remains a tendency that the contact opening characteristic is deteriorated.

SUMMARY OF THE INVENTION

A primary object of the present invention is, therefore, to provide a sealed contact device which can eliminate the foregoing problems and improve the contact closing and opening characteristics.

According to the present invention, the above object can be achieved by a sealed contact device which comprises a sealed contact section including a sealed container defining therein a gas-tight space together with a bellows for housing therein electrodes and sealing therein preferably a gas consisting mainly of hydrogen, a fixed electrode, a movable electrode provided for engaging with and separating from the fixed electrode, a contact pressure spring for urging the movable electrode in a direction of engaging the movable electrode with the fixed electrode, a resetting spring for urging the movable electrode in a direction of separating the movable electrode from the fixed electrode, and a movable shaft projected at one end out of the sealed container and coupled at the other end to the movable electrode; a driving member including a movable part for providing a drive force to the movable shaft of the sealed contact section; and a relaying member interposed between the movable shaft of the sealed contact section and the movable part of the driving member to relay the drive force of the driving member to the movable shaft, the relaying member having means coupled to the movable shaft of the sealed contact section for regulating the driving position with respect to the movable shaft. The above arrangement is characterized in that the relaying member is provided with a coupling element coupled at one portion to the movable part of the driving member and having at another portion the regulating means which is coupled to the movable shaft of the sealed contact section.

According to the above arrangement of the present invention, it is made possible to regulate the drive position of the movable shaft through the regulating means of the coupling element, and to enlarge the kinetic energy converted from energies of the contact pressure and resetting springs since the coupling of the relaying member at the coupling element to the movable part of the driving member render the mass to be increased, and consequently to have the slightly welded contacts separated.

Other objects and advantages of the present invention shall become clear as the description of the invention advances with reference to preferred embodiments shown in accompanying drawings.

BRIEF DESCRIPTION OF THE DRAWINGS

FIG. 28 shows in a perspective view as disassembled a practical arrangement embodying the embodiment of FIG. 15 and so on;

Figure 1:
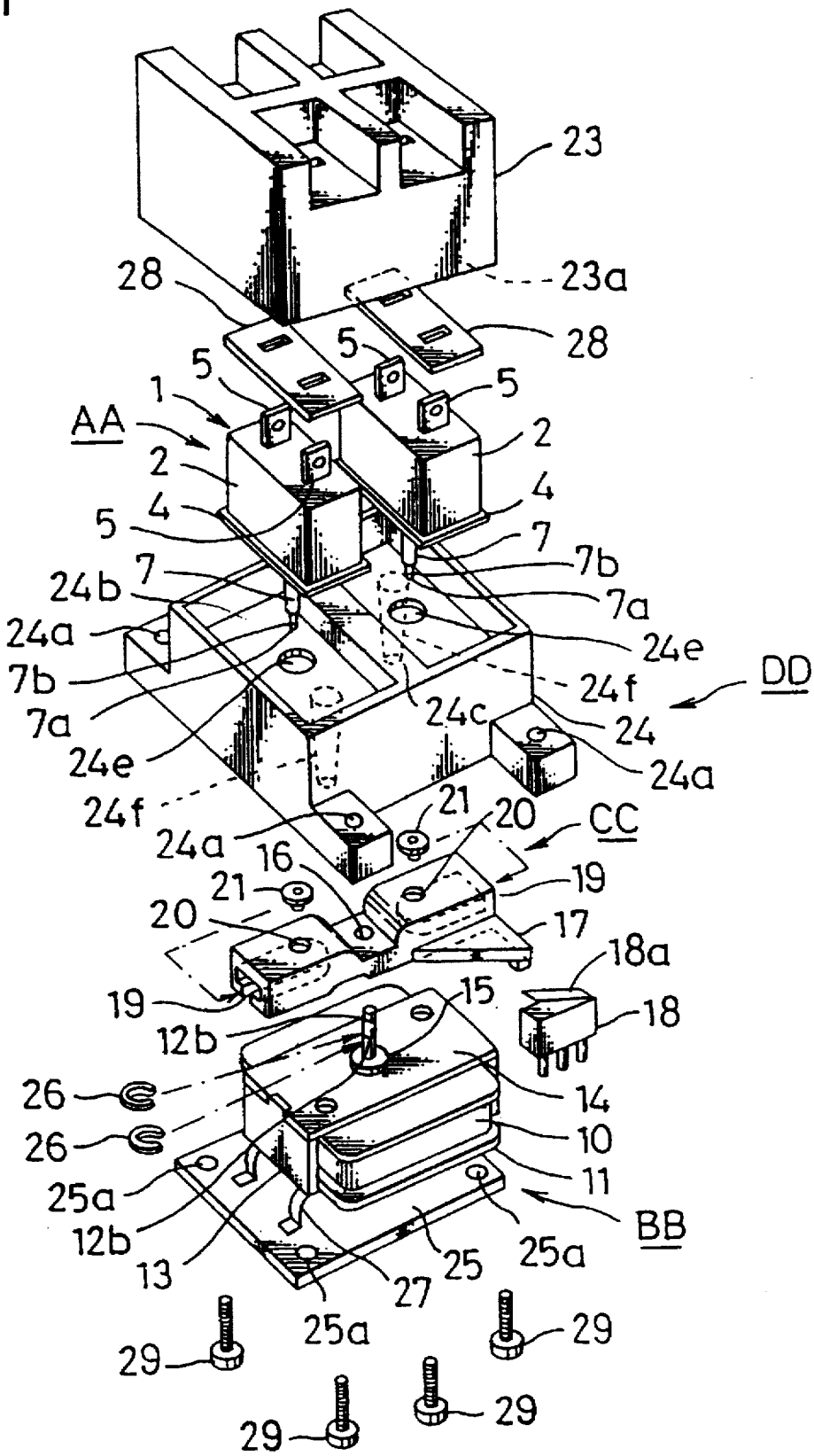
FIG. 1 shows a disassembled perspective view of the sealed contact device in an embodiment according the present invention.
Figure 2:
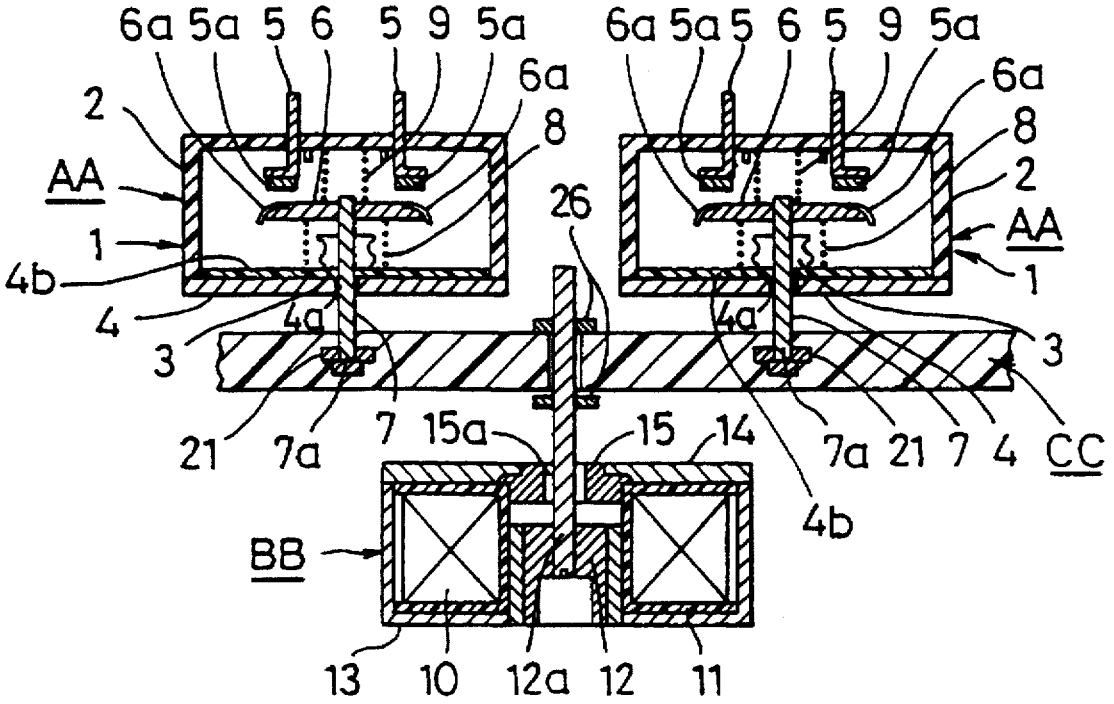
FIG. 2 is a fragmentary sectioned view showing a state in which the movable shafts of the sealed contact section and a drive shaft of the movable part in the driving member are coupled to the relaying member in the device of FIG. 1.
Figure 3:
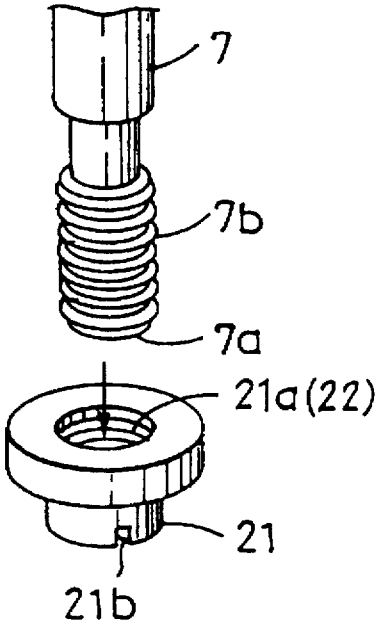
FIG. 3 is a fragmentary perspective view showing the movable shaft and the coupling element in the device of FIG. 1.
Figure 4:
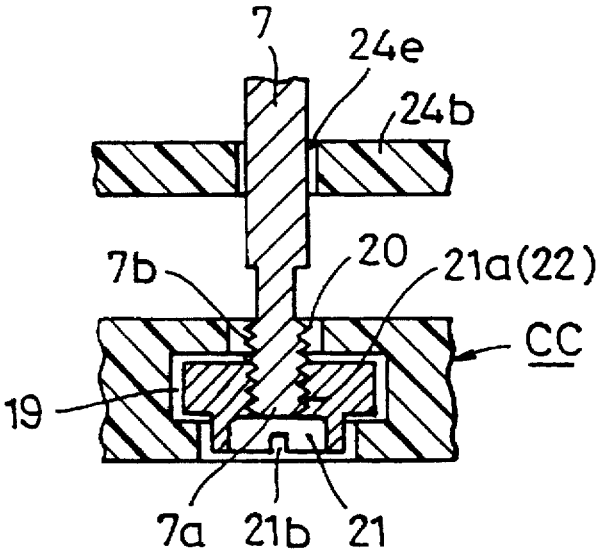
FIG. 4 is a fragmentary sectioned view showing the movable shaft of the sealed contact section and relaying member in the device of FIG. 1 in a coupled state.
Figure 5:
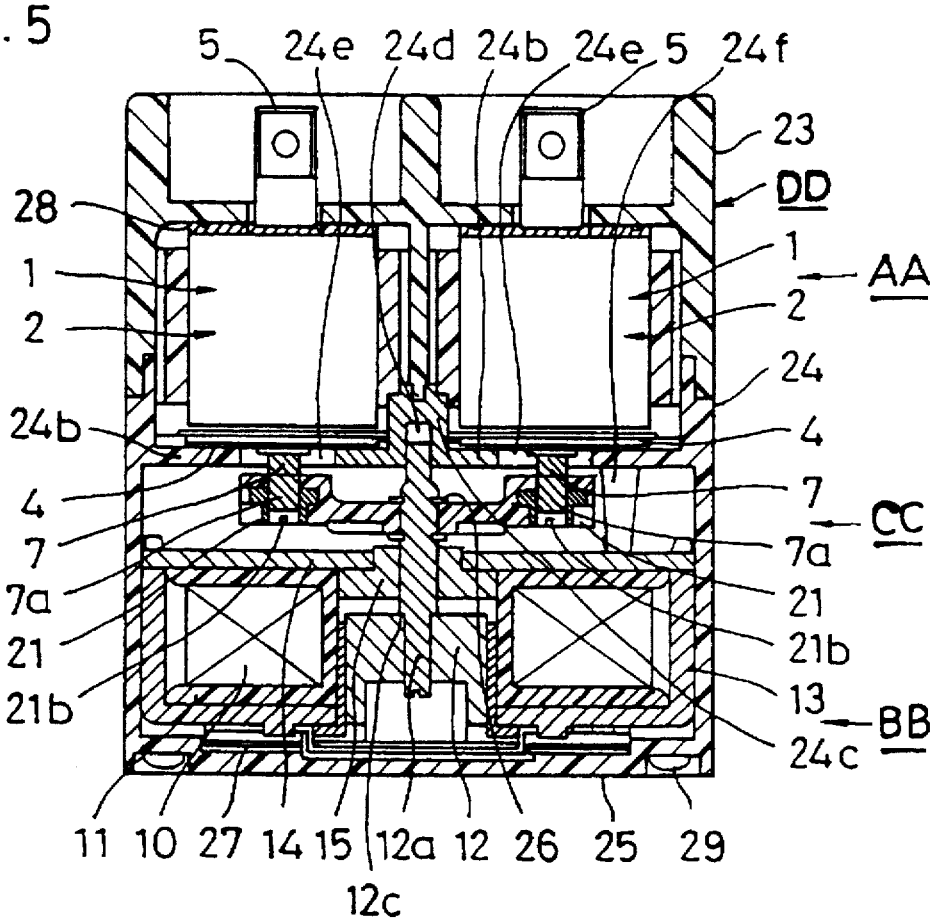
FIG. 5 is a sectioned view of the device shown in FIG. 1.

While the present invention shall now be described with reference to the respective embodiments shown in the accompanying drawings, it should be appreciated that the intention is not to limit the invention only to these embodiments but rather to include all alterations, modifications and equivalent arrangements possible within the scope of appended claims.

DETAILED DESCRIPTION OF THE PREFERRED EMBODIMENTS

In FIGS. 1 to 5, there is shown the sealed contact device in an embodiment according to the present invention. In this case, the sealed contact device comprises a sealed contact section AA, a driving member BB, a relaying member CC and housing DD.

In the illustrated case, the device employs two of the sealed contact section AA, each of which sections includes a sealed container 1. The sealed container 1 defines a gas-tight space by means of a container body 2 formed with such heat-resisting material as a ceramic material. The container 1 has a box shape and includes an open end. The container 1 includles a bellows 3 formed with a corrugated thin metal tube, a lid 4 formed by a 42 alloy or a similar material such as that disclosed in U.S. Pat. No. 4,866,227. The lid 4 includes a central through hole 4*a* and a ventilating hole (not shown). A bellows support (not shown) is provided and includes a gas-tight bearing. A gas consisting mainly of hydrogen is charged in the interior space of the container 1, for example, through the ventilating hole to be under a pressure of about 2 atm. Thereafter, the ventilating hole is sealed. To the inner side of the lid 4, further, a planar insulating plate 4*b* made of such heat-resisting member as a ceramic material is fitted, so as to prevent the lid 4 from experiencing any discharge arc.

The sealed contact section AA further generally includes a pair of fixed electrodes 5, a common movable contactor 6 and a movable shaft 7 coupled to the movable contactor 6.

More specifically, each of the fixed electrodes 5 is formed preferably by a copper or copper alloy plate material in an L-shape, a shorter leg side end of which carries a fixed contact 5a, while this fixed contact 5a may be formed by the same material as the fixed electrode 5 to be integral therewith. The movable contactor 6 is formed preferably by copper or a copper alloy material to have a pair of movable contacts 6a secured to both longitudinal ends with mutual space adapted for engagement with and separation form the fixed contacts 5a. These movable contacts 6a may be provided integral with the movable contactors 6 with the same material.

The movable shaft 7 is formed in a round rod shape and projected at one end 7a out of the sealed container 1 through the bellows 3 and lid 4, and screw threads 7b are provided to the peripheral surface adjacent to tip end of the projected end 7a. A contact pressure spring 8 in a coil shape is disposed for resiliently urging the movable contactor and shaft 6 and 7 in a direction of engaging the movable contacts 6a with the fixed contacts 5a. Further, a resetting spring 9 in a coil shape is provided for resiliently urging the movable contactor 6 in a direction of separating the movable contacts 6a from the fixed contacts 5a.

Further, in a preferred embodiment, a magnetic means (not shown) including a permanent magnet and a yoke enclosing the magnet is provided about the outer surface of the container body 2 so that the yoke will surround the fixed and movable contacts 5a and 6a. The magnetic means provides a magnetic field in a direction perpendicular to the operating direction of the movable contacts 6a to a space where the contacts 5a and 6a are present.

Referring now to the driving member BB, this member is an electromagnetic device, in which coils 10 are wound on a coil bobbin 11. A movable core 12 is formed in a columnar shape securing at an axial end part an end of a drive shaft 12a and is disposed within an axial through hole of the coil bobbin 11 to be movable in axial directions upon excitation of the coils 10. A yoke-13 is formed in a substantially U-shape having a central plate part and both erected end parts for externally enclosing the coils 10 at diametral position of the coils. An additional yoke plate 14 is secured across both erected end parts of the yoke 13. A stationary core 15 having a through hole 15a for passing the drive shaft 12a is fixed at an axial end in a central hole of the yoke plate 14. Further, the drive shaft 12a is provided adjacent to the other end thereof with a pair of peripheral grooves 12b mutually spaced in axial direction by a distance corresponding to the thickness of the relaying member CC described next.

Referring to the relaying member CC, this member is formed with a molding material having an insulating property, which material should cause no deformation nor damage due to a load of the various springs in the sealed contact section AA, attractive force of the driving member BB as well as any impact upon later described fusion bonding and should be high in bending strength and tension strength and still light. Further, the relaying member CC is formed substantially in a rectangular parallelepiped, and a through hole 16 is made in the central part to penetrate from one side surface to the other side surface. This through hole 16 is formed for passing therethrough the drive shaft 12a of the driving member BB, and the relaying member CC has a laterally expanding pressing arm 17 for pressing a lever 18a of an auxiliary switch 18. In keeping any vibratory motion of the pressing arm 17 occurring upon pressing to a minimum, it is preferable to minimize a gap between the inner periphery of the through hole 16 and the outer periphery of the drive shaft 12a. In both end portions in longitudinal direction of the relaying member CC, there are provided guide holes 19 extending in the longitudinal direction and opened at both longitudinal ends of the member CC and along bottom side surface of the member CC while such bottom side opening is made narrower than a substantial part of the holes 19 opened at the both ends. Communicating through holes 20 are made at the innermost positions of the guide holes 19 to communicate the holes 19 with the exterior. The communicating through holes 20 are disposed on the top side of the relaying member CC at positions opposing downward ends of the movable shafts 7 of the sealed contact section AA.

In the innermost positions of the guide holes 19, coupling elements 21 made of a metal material in a generally short river-like cylindrical shape having a larger diameter at a top part than at the bottom part are disposed at the innermost positions of the guide holes 19 as inserted from their endwise opening and guided along the length of the holes 19, while the coupling elements 21 are so dimensioned as to provide a gap of about 0.1 to 0.2 mm with respect to the inner peripheral surface of the holes 19 so that, even when two or more pairs of the fixed and movable contacts 15 and 16 as well as two or more movable shafts 7 are employed, any difference in the driving positions of the movable shafts 7 as adjusted, mounting gradient of the respective sealed contact sections AA to the housing DD and molded precision of the sections AA and housing DD, such difference may be restricted. This is because, in a state where the movable shafts 7 are diagonally disposed with respect to the relaying member CC, the movable shafts 7 will not be driven in any predetermined direction even when the relaying member CC is driven electromagnetically with the excitation of the coils 10, consequent to which there occur an increase in the friction at bearing parts of the movable shafts 7 within the sealed contact sections AA, and a damage to the bellows 3 keeping the gas-tightness, which may cause any fatal damage to occur in the sealed contact device. With respect to the gap in the axial direction, however, it is desirable to attain the minimum required since the movable shafts 7 may have to be excessively displaced at the time when the movable contactors 6 are forcibly tripped, as will be described later.

Further, the coupling element 21 is formed to have an axial through hole, the inner peripheral surface of which is provided at upper portion corresponding to the larger diametered part with screw threads 21a constituting a regulating means 2.2. This portion having the screw threads 21a is set to have an axial length required for adjusting the driving position of the movable shaft 7 as will be described later, and the threads 21a are formed to have a sufficient tensile strength. In tip end surface of the other smaller diametered part of the element 21, a diametral groove 21b formed to receive a tip end of screw driver for axially rotating the coupling element 21 and thus varying coupling or driving position of the element 21 with respect to the movable shaft 7. The coupling element 21 may not be limited to be formed by the metal material but any other material having a strength similar to metals may be likewise employed.

The housing DD shall now be referred to. The housing DD is to house therein the sealed contact section or sections AA, driving member BB and relaying member CC concurrently, while the housing DD generally comprises a case 23, case body 24 and bottom plate 25. The case 23 is formed substantially in a box shape having an opening 23a on bottom side, while the case body 24 is formed substantially in a rectangular tube shape provided on two opposite outer bottom sides with mounting arms respectively having threaded holes 24a for fixing of the entire device. An upper part of interior space of this case body 24 is partitioned by a horizontal partition 24b and a central vertical partition 24c, a journal hole 24d is provided in the center of the vertical partition 24c for bearing an upper end of the drive shaft 12a of the driving member BB, through holes 24e for passing lower ends of the movable shafts 7 are made in the horizontal partition 24b at both side positions of the journal hole 24d, and two vertical projections 24f are provided to extend from the horizontal partition toward bottom side opening, at positions for suitably positioning the yoke plate 14 of the driving member BB. A bottom plate 25 having threaded holes 25a at respective corners is to be fitted to the bottom side opening of the case body 24.

Next, assembling sequence of the foregoing constituents shall be referred to. First, as shown in FIG. 1, two sealed contact sections AA are assembled in the case 23 and fixed therein in a state where elastic members 28 are interposed between an inner surface of the case 23 and the container body 2 of the respective sections AA for absorbing any dimensional tolerance. Thereafter, the case 23 and case body 24 are coupled to each other through a joining means which comprises screw members or such fitting members as plate springs, E-rings or the like (not shown). Then, the drive shaft 12a of the driving member BB is passed through the hole 16 of the relaying member CC, such fixing metal fittings 26 as E-rings or the like are fitted to the peripheral grooves 12b of the drive shaft 12a above and below the relaying member CC, so as to prevent the drive shaft 12a from being separated from the relaying member CC. The coupling elements 21 are inserted into the guide holes 19 of the relaying member CC from the endwise openings of the holes, with the smaller diametered part of the coupling element 21 disposed in the bottom side opening of the hole 19.

Next, in a state in which the top side tip end of the drive shaft 12a of the driving member BB is inserted in the journal hole 24d of the case body 24, the coupling element 21 is axially rotated to a proper extent for meshing the screw threads 21a of the element 21 with the screw threads 7b of the movable shaft 7, so as to screw the element to the movable shaft 7. In this state, the drive shaft 12a is urged down by a jig (not shown) to a predetermined position, with the two projections 24f in the case body 24 used as a reference, at which state the coupling element 21 is axially rotated until a closed state of the fixed and movable contacts 5a and 6a is reached, with the screw driver (not shown) fitted in the groove 21b of the element 21, so as to adjust the driving position of the movable shaft 7, the jig is then disengaged, and the auxiliary switch 18 is fixed to the housing DD at a position where the lever 18a is depressed by pressing arm 17 of the relaying member CC.

Next, the driving member BB is incorporated into the case body 24. That is, the yoke plate 14 including the fixed core 15 is first inserted into the case body 24 with its projections 24f used as the reference, then the coil bobbin 11 with the coils 10 wound thereon and the yoke 13 are sequentially incorporated, and the movable core 12 is fixed to the drive shaft 12a. With a stepped part 12c provided to the drive shaft 12a, the core 12 may be reliably positioned and fixed with respect to the shaft 12a. Elastic springs 27 are fixed to bottom side of the yoke 13, so that the driving member BB as a whole maybe positioned with respect to the case body 24.

Finally, the bottom plate 25 is fitted to the bottom side opening of the case body 24 against resilient force of the springs 27 of the driving member BB, the screws 29 are fastened into the threaded holes 25a and further into other threaded holes than the holes 24a of the case body 24, and the sealed contact device can be assembled.

Further, the operation of the sealed contact device shall be referred to. As the coils 10 are excited, the movable core 12 is attracted to the fixed core 15 to generate a driving force, the drive shaft 12a fixed to the movable core 12 is driven, the driving force is transmitted to the relaying member CC fixedly coupled to the drive shaft 12 by means of the fixing metal fittings 26, the ends 7a of the movable shafts 7 are driven by the driving force larger than the resilient force of the resetting springs 9 through the coupling elements 21 disposed within the relaying member CC, and the movable contacts of the movable contactors 6 are engaged with the fixed contacts 5a. At this time, the pressing arm 17 of the relaying member CC is to release or press the lever 18a of the auxiliary switch 18, to actuate this switch. Thereafter, the resilient force of the contact pressure spring 8 is additionally applied to the movable shafts 7 to push these shafts 7 by a predetermined overtravelling component.

As the excitation of the coils 10 is ceased, the movable contactors 6 are caused to reset due to the resetting force resisting against the contact pressure spring 8 and so on so that the movable contacts 6a are separated from the fixed contacts 5a and, at the same time, the movable core 12 also returns to the original position through a resetting action by a predetermined distance until it collides with the bottom plate 25 of the housing EE to be thereby restricted. At this time, the pressing by the arm 17 of the relaying member CC with respect to the lever 18a of the auxiliary switch 18 is reset or released, and the auxiliary switch 18 operates in a direction opposite to that upon the contact engagement. Further, the arc generated between the contacts upon the resetting is sufficiently expanded towards both ends of the movable contactors due to an action of magnetic field of a well known magnetic means (not shown) so as to be distinguished.

During such a series of actions, the coupling elements 21 are actuated in such manner as will be explained in the followings. First, the coupling elements 21 are biased back to the sealed contact section AA side by the resetting spring in a period from the excitation of the coils 10 to the engagement of the movable contacts 6a with the fixed contacts 5a, and by the resetting spring 9 and contact pressure spring 8 in a period of the overtravelling after the contact closing of the movable and fixed contacts 6a and 5a. With this arrangement, the coupling elements 21 are provided to have a constant positional relationship to the relaying member CC.

Next, references shall be made to a tripping operation against the fusion welding, in particular, a slight fusion welding caused upon occurrence of a fusion between the movable contacts 6a and the fixed contacts 5a due to any excess current load or excessive rush current. As the fusion welding of contacts takes place, the movable contactor 6 carrying the contacts 6a come into a state where they are secured as fusion-welded at one or two points to the fixed electrodes 5 carrying the fixed contacts 5a during the excitation of the coils 10. If the excitation of the coils 10 is ceased in this state, the movable contactors 6 become about to reset with the biasing force of the contact pressure spring 8 and resetting spring 9 here made effective but cannot be actuated as being secured to the fixed electrodes 5, and the movable shafts 7 tend to stop after a resetting only by a stroke of the overtravelling. At this time, as the arrangement is so made that the movable shafts 7 are coupled to the coupling elements 21 to be indirectly connected to the relaying member CC, drive shaft 12a and movable core 12, the kinetic energy converted from the spring load energy at the time of the overtravelling as a result of a displacement of the movable shafts 7 from the maximum overtravelling state to an overtravel-free state is made 10 to 20 times as large as that in conventional arrangements in which the movable shaft only displaces independently without being coupled to the relaying member CC, because of the mass increased by an extent less than that of the relaying member CC while it depends on the shape or material. Consequently, the contacts mutually fusion-welded can be separated in a moment by such kinetic energy.

Figure 6:
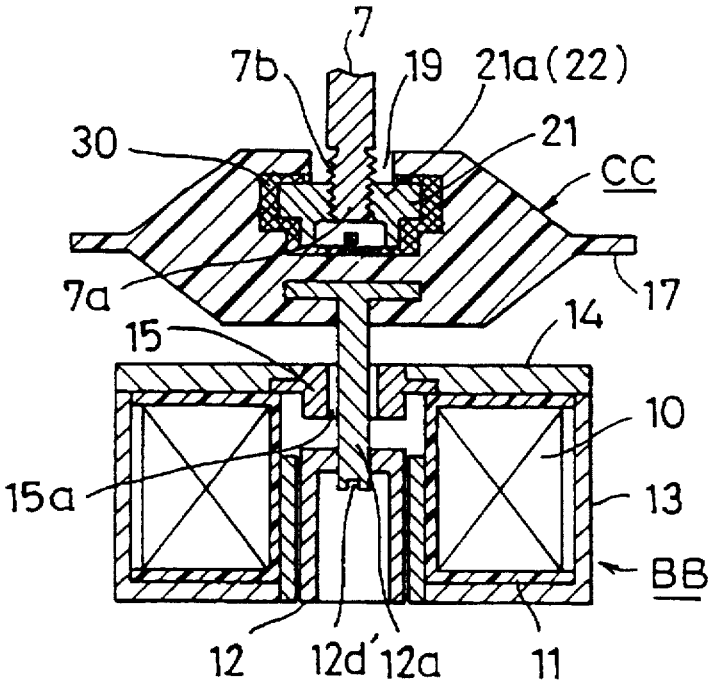
FIG. 6 is a fragmentary sectioned view showing a coupling state of both of the movable shaft of the sealed contact section and the drive shaft of the driving member to the relaying member in another embodiment of the present invention.
Figure 7:
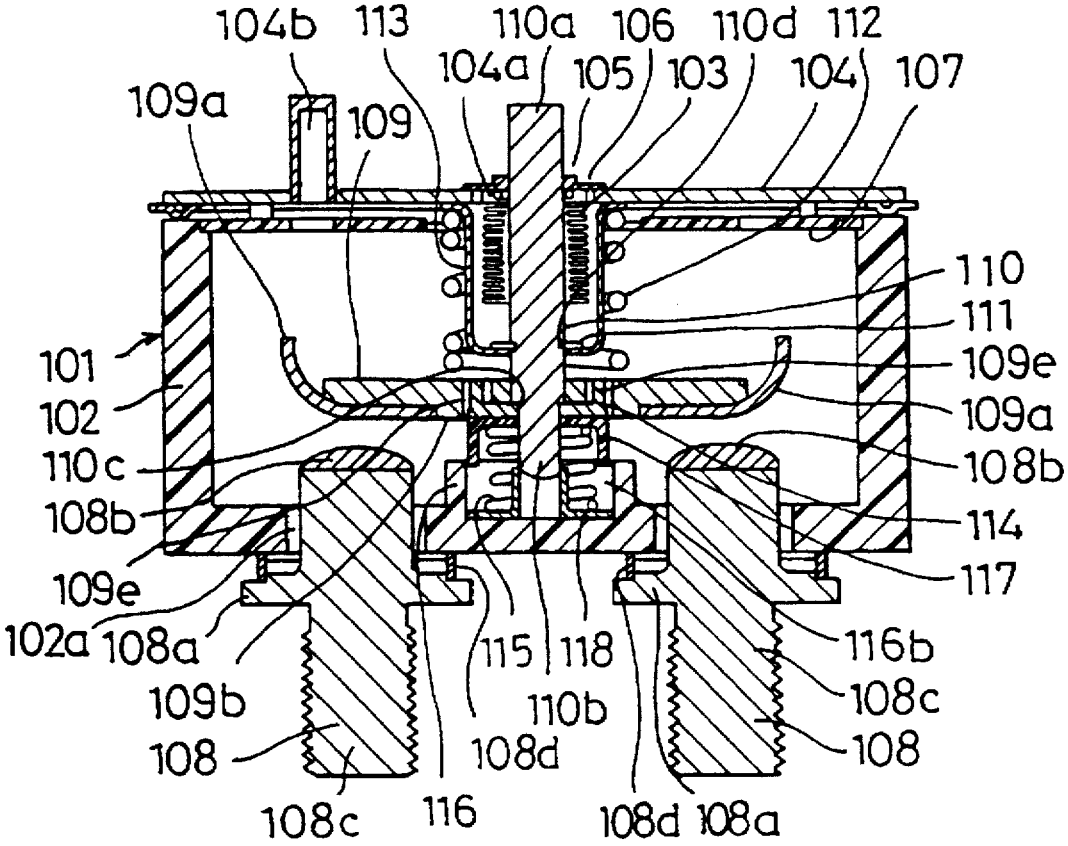
FIG. 7 is a sectioned view of the sealed contact section in another embodiment of the device according to the present invention.
Figure 8:
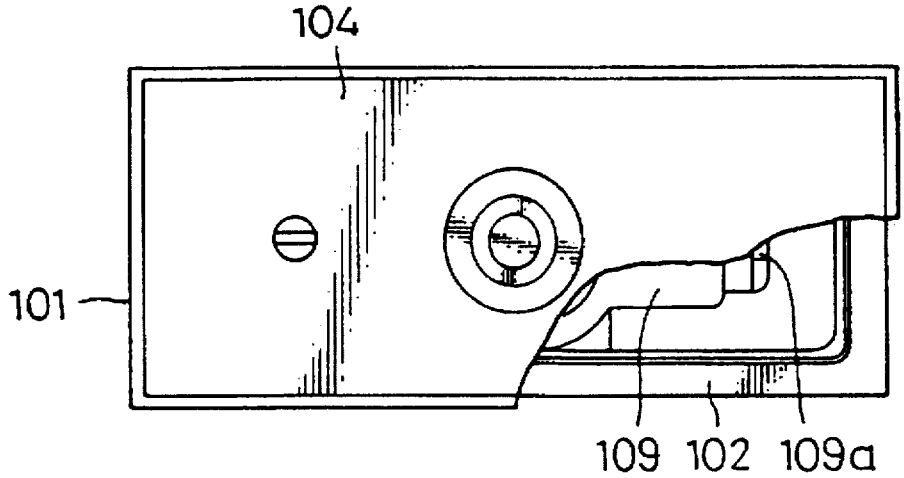
FIG. 8 is a top plan view with part omitted of the sealed contact section of FIG. 7.
Figure 9:
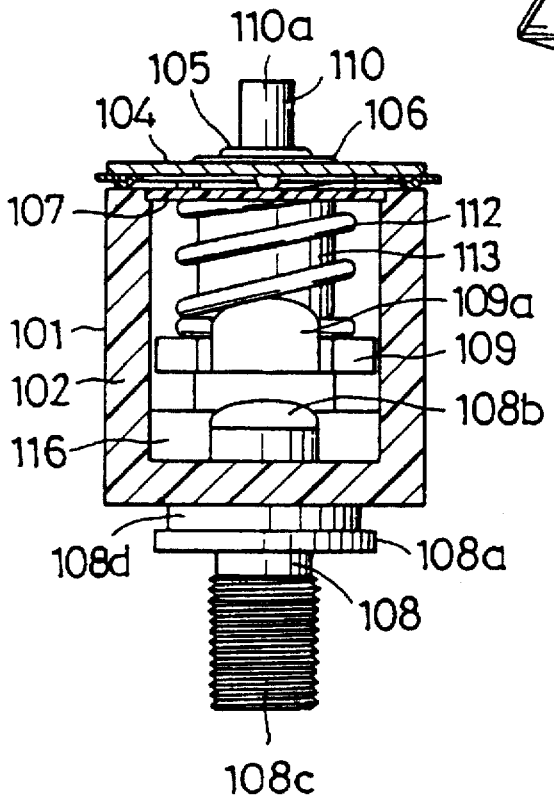
FIG. 9 is a sectioned view of the sealed contact section of FIG. 7.
Figure 10:
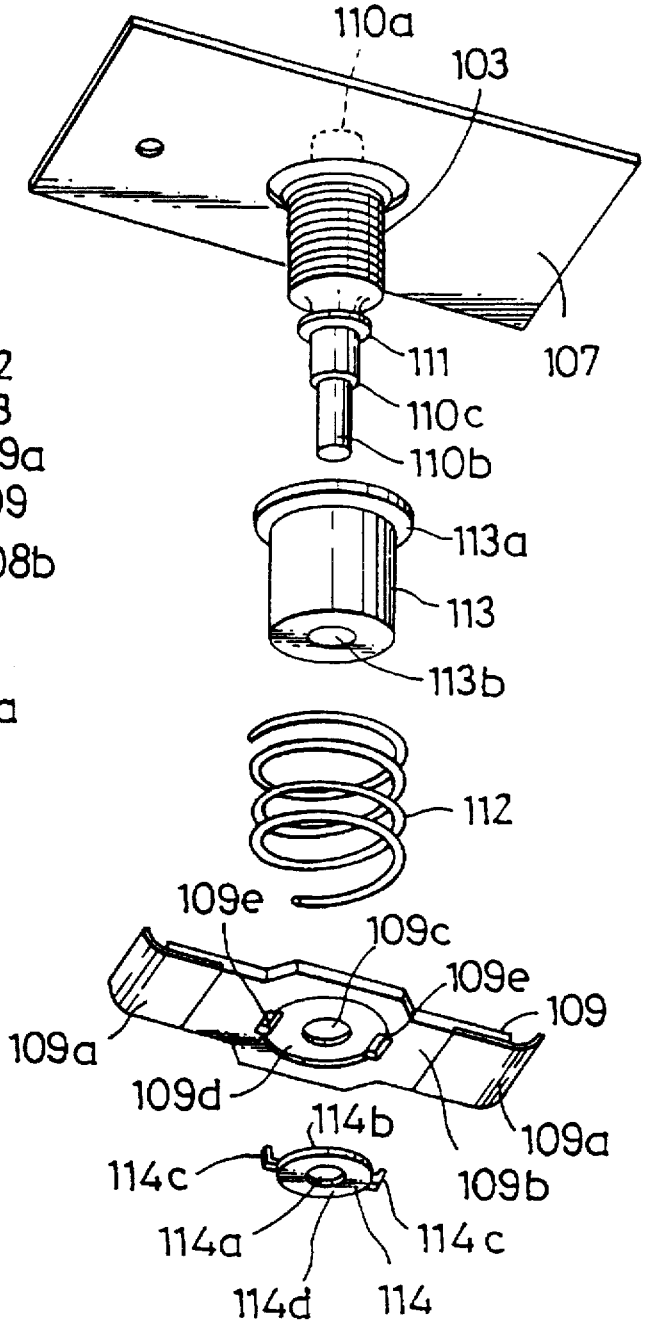
FIG. 10 shows in a perspective view as disassembled a state in which a movable contactor holder is mounted to the movable shaft in the sealed contact section of FIG. 7.
Figure 11:
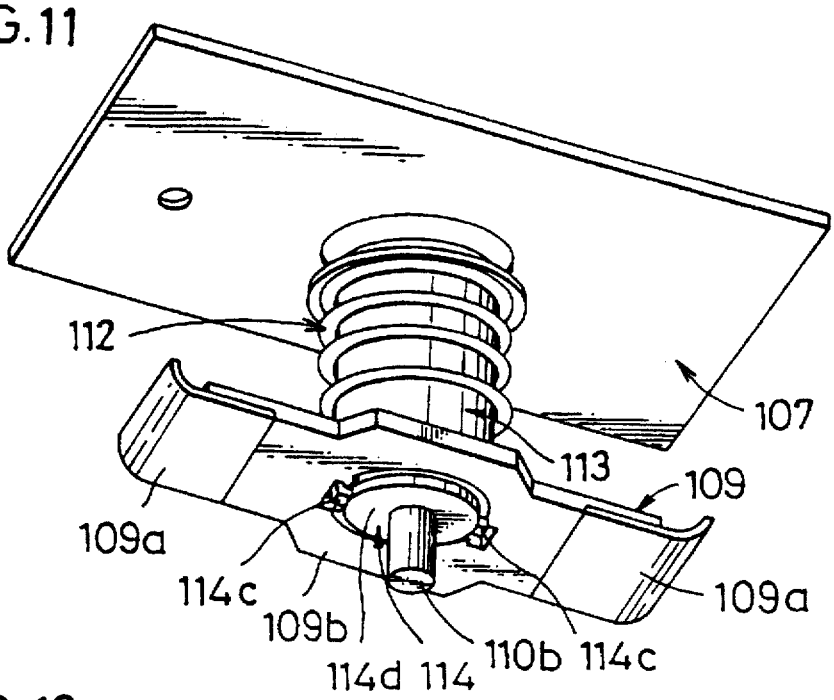
FIGURE 11 is a perspective view of the movable contactor holder mounted to the movable shaft in the sealed contact section of FIG. 7.
Figure 12:
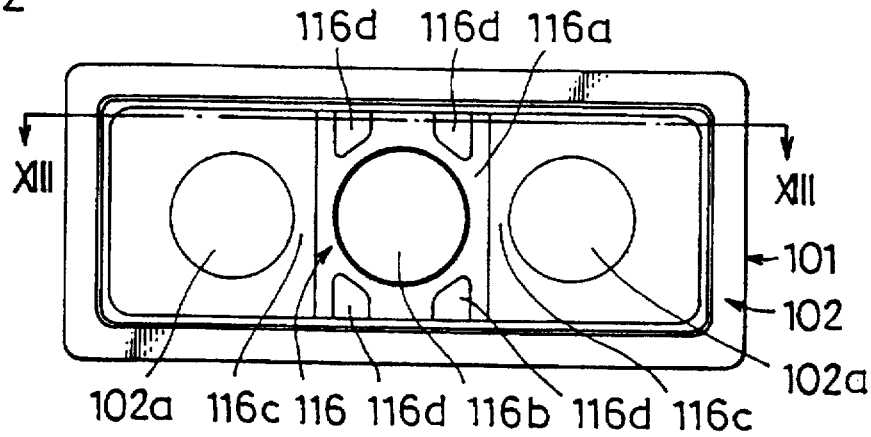
FIG. 12 is a top plan view of the sealed container in the sealed contact section of FIG. 7.
Figure 13:
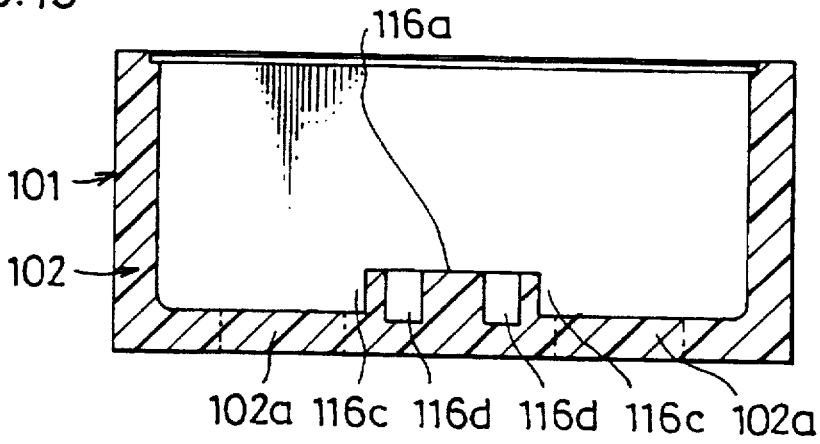
FIG. 13 is a sectioned view of the container of FIG. 12 taken along the, line XIII—XIII.

In FIG. 6, there is shown another embodiment of the present invention, in which the arrangement is made to be of a single pole comprising a single movable shaft while the foregoing embodiment is of the two pole arrangement with the two movable shafts 7 employed. In FIG. 6, substantially the same parts as those in the embodiment of FIGS. 1–5 are denoted by the same reference figures, and the aspects different from those in the embodiment of FIGS. 1–5 only shall be detailed.

That is, the relaying member CC in this embodiment is formed in a disk shape, the guide hole 19 is made in the top side of the disk CC to have upward opening the width of which and a bottom part of which is smaller than an intermediate part, while this hole 19 is made to communicate with the exterior at least on one side. In this hole 19, the coupling element 21 for coupling thereto the movable shaft 7 and provided with the regulating means 22 is disposed, and this coupling element 21 is forming a screwing part rotatable about the movable shaft 7. Further, the drive shaft 12*a* is secured at upward end to the relaying member CC and is provided at the other end with the diametral groove 12*d* for the positioning of the tip end of the screw driver. Thus the drive shaft 12*a* is positioned coaxial with the movable shaft 7 when the latter is coupled through the coupling element 21 to the relaying member CC.

Referring to an assembling sequence of the present embodiment, further, the coupling element 21 is first inserted in the guide hole 19 from the externally communicating side, with the larger diametered part of the element 21 disposed on the top side of the relaying member CC, and the thus inserted coupling element 21 is positioned in the center of the member CC and is then secured in position by an adhesive 30 or the like. The relaying member CC is then rotated by a proper extent and the coupling element 21 is screwed to the movable shaft 7 through the screw threads 21*a* and 7*b*. Placing the tip end of the screw driver (not shown) in the groove 12*b* at the other downward end of the drive shaft 12*a*, the shaft 12*a* is rotated until both contacts 5*a* and 6*a* are closed so as to fix the relaying member CC with respect to the housing DD at a predetermined position, with the jig kept in the state of being held, thereafter the jig is disengaged, and the movable shaft 7 and coupling element 21 are secured to each other by means of an adhesive, laser welding or the like. Then the auxiliary switch 18 is fixed to the housing DD so that its lever 18*a* will be depressed by the pressing arm 17 of the relaying member CC.

Thereafter, the driving member BB is to be assembled into the case body 24, such that the yoke plate 14 carrying the fixed core 15 is first fitted to the bottom opening of the case body 24 with its projections 24*f* used as the reference, the movable core 12 is secured to the drive shaft 12*a* at a proper position by means of the screwing or adhesive, and thereafter the coil bobbin with the coils 10 wound thereon and the yoke 13 are sequentially assembled. Thereafter, the same assembling as in the embodiment of FIGS. 1–5 is carried out and the sealed contact device can be thereby assembled.

In either one of the embodiments of FIGS. 1–5 and FIG. 6 of the sealed contact device, the movable shaft 7 is made adjustable in the driving position by means of the adjusting means 22 provided to the coupling element 21 and is coupled through the coupling element 21 to the relaying member CC which is connected to the movable core 12 so as to increase the mass, so that the kinetic energy converted from the energy of the contact pressure spring 8 and resetting spring 9 is made larger, the contacts involving slight fusion-welding can be tripped, and the contact opening and closing characteristics can be improved.

While in the sealed contact device in the embodiment of FIG. 6 such direct adjustment of the coupling element 21 as in the embodiment of FIGS. 1–5 from the side of the movable core 12 cannot be made because of the coaxial disposition of the movable core 12 and movable shaft 7, the driving position of the movable shaft 7 can be adjusted by rotating the relaying member CC carrying the coupling element 21 provided with the screwing part rotatable about the movable shaft 7 made as the center, by means of the screw driver (not shown) placed in the groove 12*d* made in the drive shaft 12*a*.

In either one of the embodiments of FIGS. 1–5 and FIG. 6 of the sealed contact device, further, the adjustment of the driving position of the movable shaft 7 causes the screwing position of the coupling element 21 to the movable shaft 7 only to be displaced and the position of the relaying member CC displace in the axial direction of the movable shaft 7, so that the positional relationship between the lever 18*a* of the auxiliary switch 18 and the pressing arm 17 of the relaying member CC is not changed, and the arrangement can be so made that the mounting position of the auxiliary switch 18 needs not be modified.

According to another feature of the present invention, there is adopted an arrangement in which any arc generated upon the separation of electrodes and expanded in inverse direction can be restricted from causing any trouble to occur in the electrode opening and closing characteristics.

In FIGS. 7–14, there is shown another embodiment of the present invention, in which the sealed container 101 of the sealed contact section AA is arranged to define the gas-tight space by means of the container body 102 formed into a box shape having an open side with such heat-resisting material as a ceramic material. The bellows 103 are formed with a thin metal tube that is corrugated. The lid 104 is made by 42 alloy or the like and has a central through hole 104*a* and a ventilating hole 104*b* disposed at a propor position, and the bellows support 106 is provided with a first bearing 105. That is, the lid 104 is joined to the container body 102 so as to close its open side, while the bellows 103 is gas-tightly joined at one end part to the lide 104 to be held by the bellows holder 106 and at the other end part to the movable shaft 110 later described. To the inner side of the lid 104, a planar insulating plate 107 made of such heat-resisting material as a ceramic material is fitted for protection of the lid 104 from the arc.

While the gas-tight space in the sealed container 101 is formed in this manner, the gas mainly consisting of hydrogen is charged in the interior of the container to be about 2 atm., for example, through the ventilating hole 104*b* and therafter the ventilating hole 104*b* is sealed. The fixed electrodes 108 provided in a pair are formed by copper or a copper alloy material, for example, substantially in a columnar shape provided at the center part with a flange 108*a* and at one end with the fixed contacts 108*b* secured, while these fixed contacts 108*b* may be formed integral with the fixed electrode 108 by the same material as the electrode 108. Further, the other ends of the fixed electrodes 108 are provided with the screw threads and are projected out of through holes 102*a* made in the container body 101. These fixed electrodes 108 are gas-tightly joined at their flanges 108*a* through a flange member 108*d* made by the 42 alloy or the like.

The movable contactor 109 is formed by copper or a copper alloy plate member to be provided at both longitudinal end parts and on one side surface with the movable contacts 109*a* mutually spaced by a distanced capable of engaging with and being separated from the fixed contacts 108*b*, and these movable contacts 109*a* themselves are arranged to be bent to form a horn part. Further, the movable contacts 109*a* may be formed integral with the movable contactor 109 with the same material. On the one side surface 109*b* of the movable contactor 109, a recess 109*d* having in the center a through hole 109*c* and substantially circular shape in the plan view is provided, and a pair of diametrally opposing holes 109*e* are made along inner edge of the recess 109*e*.

The movable shaft 110 is formed in a round rod shape, which is, when assembled, projected out of the sealing container 101 at one end 110*a* and thinned at part adjacent to the other end 110*b* to constitute a stepped part 110*c*. In the outer periphery of central part of the movable shaft 110, a circumferential groove 110*d* is provided, and such flange-like member 111 as an E-ring or the like is fitted to this groove 110*d*. Further, this movable shaft 110 is supported at such two positions as the one end 110*a* passed through the through hole 105*a* made in first bearing 105, and as the other end 110*d* passed through the through hole 118*a* provided in second bearing 118 described later.

The contact pressure spring 112 is formed in the coil shape having an inner diameter slightly larger than the outer diameter of a contact pressure spring frame 113 detailed below. The contact pressure spring frame 113 is formed in a bottomed cylinder shape provided at top open end with a flange 113*a* and in bottom part with a through hole 113*b*, and this contact pressure spring frame 113 also performs an action of protecting the bellows 103. A disk-shaped movable contactor holder 114 is made to have a central through hole 114*a*, the disk shape of which having substantially the same thickness as the recess 109*d* of the movable contactor 109, and a pair of diametrally opposing pawls 114*c* are provided as erected substantially at right angles on one side surface 114*b*. These pawls 114*c* may be one or more than three. This movable contactor holder 114 is provided for achieving a positional restrictive action of the movable contactor 109 as will be described later.

The resetting spring 115 is formed in a coil shape, and is disposed within a recess 116*b* provided on one side surface 116*a* of a receptacle 116 provided in the interior of the sealed container 101, for biasing the movable contactor 109 in the direction of separating the movable contacts 109*a* from the fixed contacts 108*b*. Between this receptacle 116 and the fixed contacts 108, there is provided a gap 116*c*, and on one side surface 116*a* of the receptacle 116, grooves 116*d* are provided on outer side of the recess. Further, a resetting spring frame 117 is formed in a bottomed cylinder by such heat-resisting material as a ceramic material or the like, and is disposed on the one side surface 116*a* of the receptacle 116 so as to externally enclose the resetting spring 115. This resetting spring frame 117 passes one end 110*b* of the movable shaft 110 therethrough. A second bearing 118 is provided with a through hole 118*a* (not shown), and this second bearing 118 performs respective positional control in the axial direction of the movable shaft 110 by means of the resetting spring and in a direction intersecting at right angles the axial direction by means of the inner wall surface of the recess 116*b* of the receptacle 116.

Next, the positional restriction of the movable contactor 109 by means of the movable contactor holder 114 shall be referred to. The movable shaft 110 is passed, from its one end 110*b* side, through the contact pressure spring frame 113, contact pressure spring 112, movable contactor 109 and movable contactor holder 114, and the contact pressure spring frame 113 is secured to the movable contactor holder 114 through the stepped part 110*c*, in a state where the frame 113 is positioned by the flange-like member Ill fitted to the movable shaft 110. This movable contactor holer 114 is fitted in the recess 109*d* of the movable contactor 109 to engage at the one side surface 114*b* with the bottom face of the recess 109*d* and to dispose the other side surface 114*d* to be substantially flush with the one side surface 109*b* of the movable contactor 109. At this time, the contact pressure spring 112 is disposed as compressed between the movable contactor 109 and the flange 113*a* of the contact pressure spring frame 113, and the movable contactor 109 is biased in the direction of engaging the movable contacts 109*a* with the fixed co,n,tacts 108*b* and is to be positionally restricted by the one side sulrface 114*b* of the movable contactor holder 114 secured to the movable shaft 110.

The magnetic means (not shown) comprises a permanent magnet and a yoke holding the magnet, and is installed to the outher surface of the container body 102 so that the yoke will enclose the fixed contacts 108*b* and movable contacts 109*a*. Consequently, the magnetic means provides a magnetic field in the space where both contacts 108*b* and 109*a* are present, in a direction intersecting at right angles the operating direction of the movable contacts 109*a*.

Figure 14A:
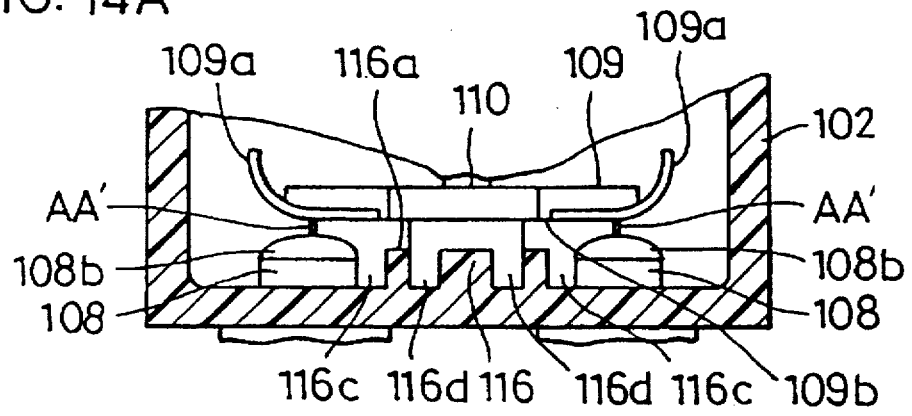
FIGS. 14A to 14D are fragmentary sectioned views for explaining states in which spark arc develops in the sealed contact section of FIG. 7.
Figure 14B:
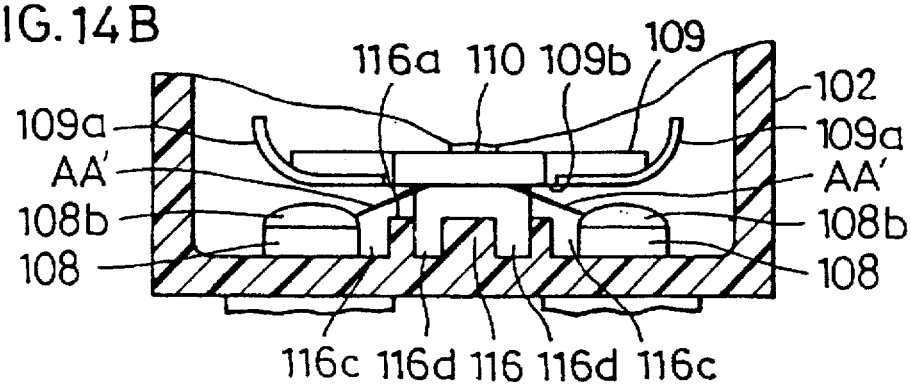
Figure 14C:
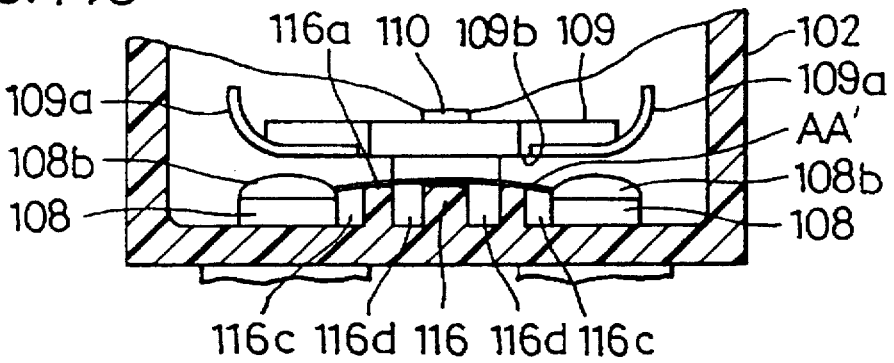
Figure 14D:
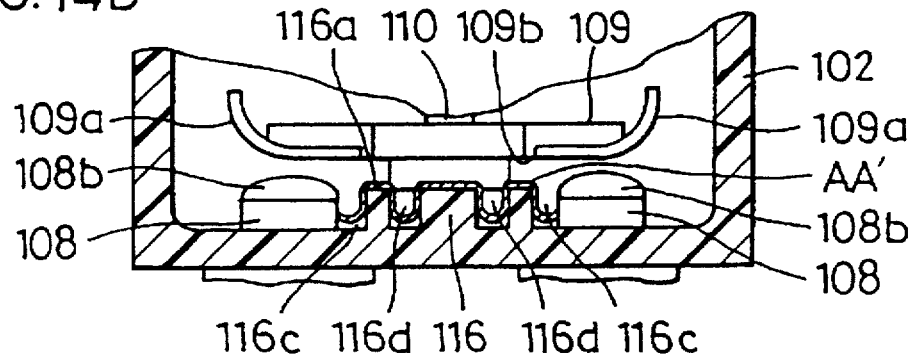

Further, the operation of the present embodiment shall be lreferred to. As the one end 110*a* of the movable shaft 110 is dirven by the electromagnetic device or the like, the movable contacts 109*a* of the movable contactor 109 engage with the fixed contacts 108*b*. As the movable shaft 110 is further driven thereafter, the movable contactor 109 the lmovable contacts 109*a* of which have alreadyl engaged with the fixed contacts 108*b* is not moved but the contact pressure spring frame 112 is moved to compress the contact pressure spring 112, and the contact pressure between the movable contacts 109*a* and the fixed contacts 108*b* is elevated. As the drive of the one end 110*a* of the movable shaft 110 is ceased, the movable shaft 110 is pushed back mainly by the spring force of the resetting spring 115, and the original state is reset. The arc AA' generated between both contacts 108*b* and 109*a* upon this resetting is expanded by the magnetic means (not shown) normally towards the horn parts at both end parts of the movable contacts in the case of DC load switch and is suppressed. Depending on the type of load and circuit state, at this time, there happens that the current flows in a direction reverse to normal, so that the arc AA' generated between both contacts 108*b* and 109*a* upon the resetting is caused to receive a reverse Lorentz force to be expanded towards the center of the movable contactor 109. This state shall be detailed in the followings on the basis of FIGS. 14A–14D. When the arcs AA' are generated between the movable contacts 109*a* and the fixed contacts 108*b* as shown in FIG. 14A, these arcs AA' tend to run along the one side surface 109*b* of the movable contactor 109 as shown in FIG. 14B and to further run along the other side surface 114*d* of the movable contactor holder 114 made flush with the one side surface 109*b* of the movable contactor 109, and eventually both arcs are joined to run between the pair of the fixed contacts 108*b*. In this state, the Lorentz force applied from the magnetic means (not shown) to the arcs AA' is effective in the contact opening and closing direction, so that the arcs AA' are caused to run the innermost part of the gaps 116*c* and along the inner edges of the grooves 116*d* of the receptacle 116, as shown in FIG. 14D, and the expansion of the arcs AA' is made sufficient.

Thus, in the sealed contacts device of the present embodiment, the arcs AA' expanded in the reverse direction upon the separation of the movable contacts 109*a* from the fixed contacts 108*b* are made to run the innermost part of the gaps 116*c* between the fixed electrodes 108 and the receptacle 116 so as to expand long as referred to in the above, the expansion of the arcs AA' is made sufficient, the breaking current is elevated, and the contact opening and closing characteristics suffer no trouble. Further, as the arcs AA' expand long along the inner periphery of the grooves 116*d* on the one side surface of the receptacle 116, the expansion of the arcs AA' is further made sufficient, the breaking current is further elevated, and the contact opening and closing characteristics can be prevented from suffering any trouble. Further, as the foregoing arcs AA' are to run along the movable contactor holder 114 received in the recess 109*d* in the one side surface 109*b* of the movable contactor 109 and made substantially flush with the surface 109*b*, the running of the arcs AA' is made smooth, and the contact opening and closing characteristics are prevented from any trouble.

While in the present embodiment the one side surface 116*a* of the receptacle 116 is provided with the grooves 116*d*, such grooves 116*d* may not be provided, so long as the arcs AA' can be expanded sufficiently long. Also in the present embodiment, the arrangement is so made to provide the gaps 116*c* between the receptacle 116 and the fixed electrodes 108 as well as the recess 109*d* in the movable contactor 109, but either one of them may be omitted so long as the contact opening and closing characteristics are not caused to suffer any trouble.

Figure 15:
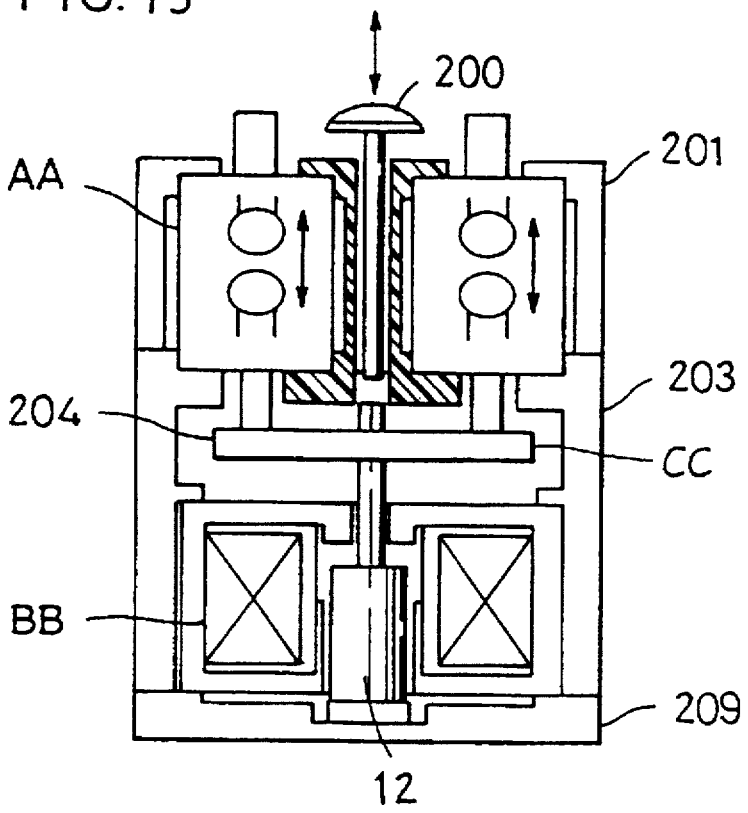
FIG. 15 shows in a schematic sectioned view the device in another embodiment according to the present invention.

Another embodiment of the present invention is shown in FIG. 15. In the sealed contact device of this embodiment, the sealed contact section AA containing the contact members and the driving member BB which is the electromagnetic device and comprising the movable member 12 are included. The movable member 12 is the movable core and the drive shaft extended from the core, while the movable shaft is coupled to an insulating molded lever 204 which is coupled at other positions to contact driving shafts included in the contact members. The contact section AA, driving member BB and movable member 12 are enclosed within housing members 201, 203 and 209. Further, a shaft lever 200 (which shall be hereinafter referred to as a lock lever) for allowing the drive shaft to occupy a movable space in the driving member (practically a movable space for the drive shaft) by varying the position of the lever up and down by a predetermined extent is provided. A tip end position of this lock lever 200 is locked at a non-contact position where no influence is given to the movable member 12 even the movable member 12 displaces due to an application of input signals so long as ordinary contactors are employed. When at this time the input signal is applied to the driving member BB, the movable core of the interior movable member 12 is attracted by the electromagnetic attractive force, the driving force is transmitted to the movable member 12, to a molded lever 204 forming the relaxing member CC and to the movable contact members within the contact section AA, and the contacts are closed in accordance with the displacing operation for the predetermined extent.

Figure 28:
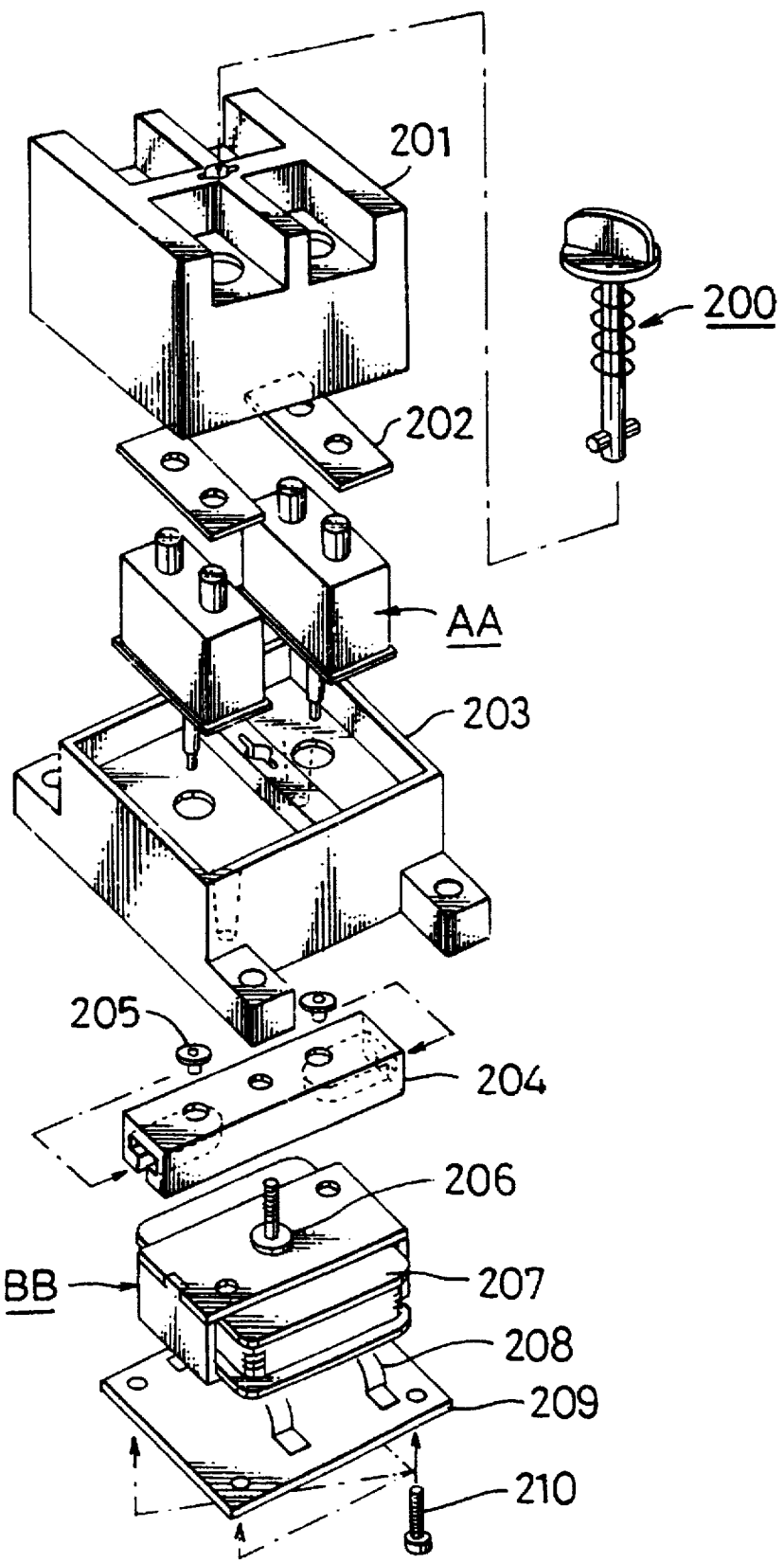
Figure 29:
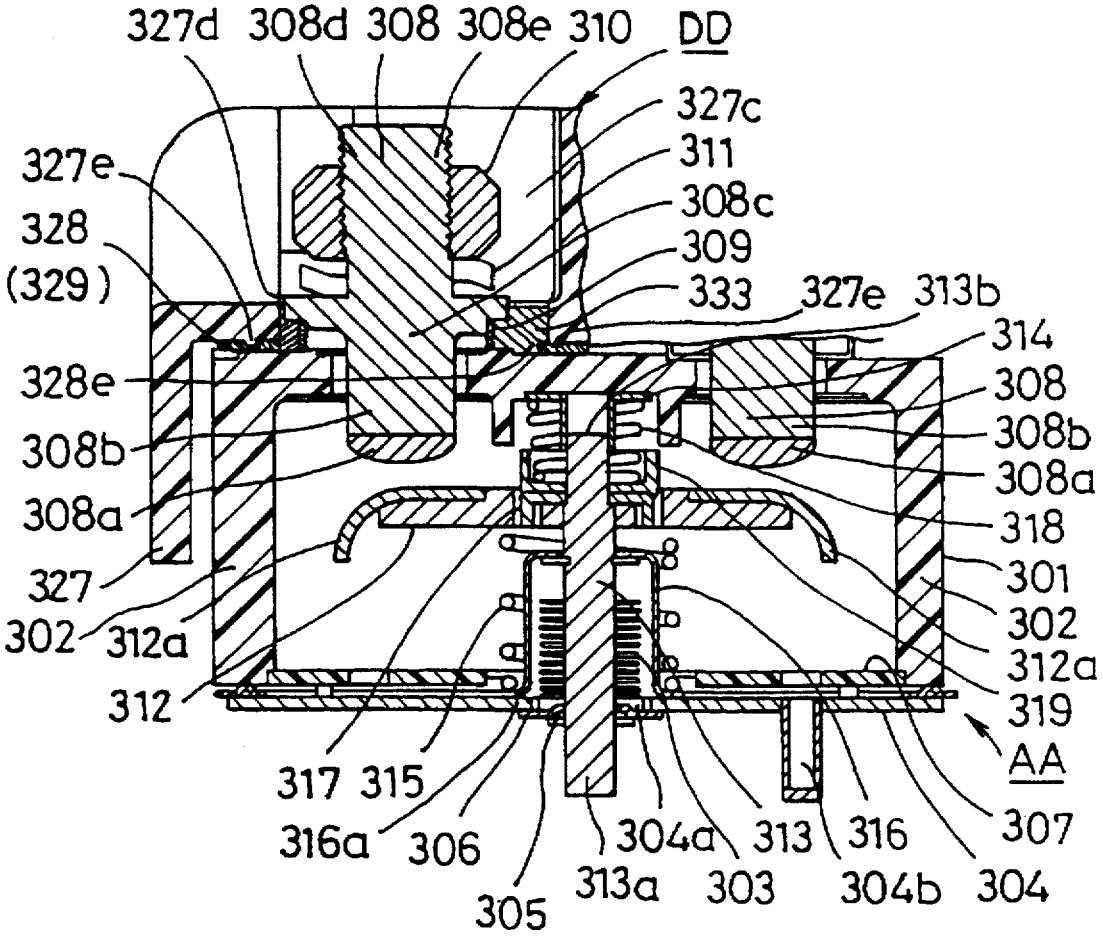
FIG. 29 is a fragmentary sectioned view at the sealed contact section and its adjacent part thereto in another embodiment according to the present invention.
Figure 30:
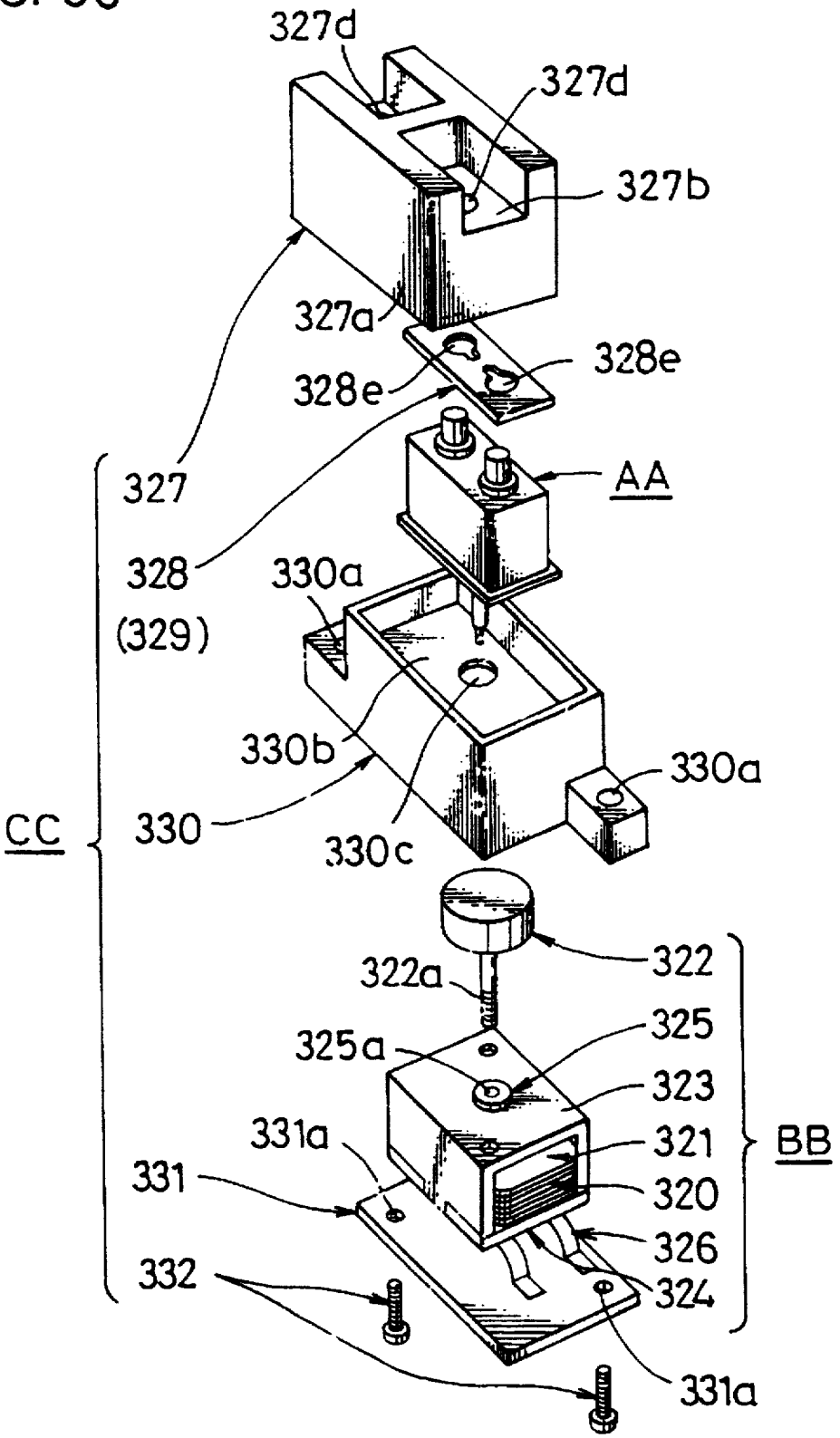
FIG. 30 is a perspective view as disassembled of the device in FIG. 29.
Figure 31:
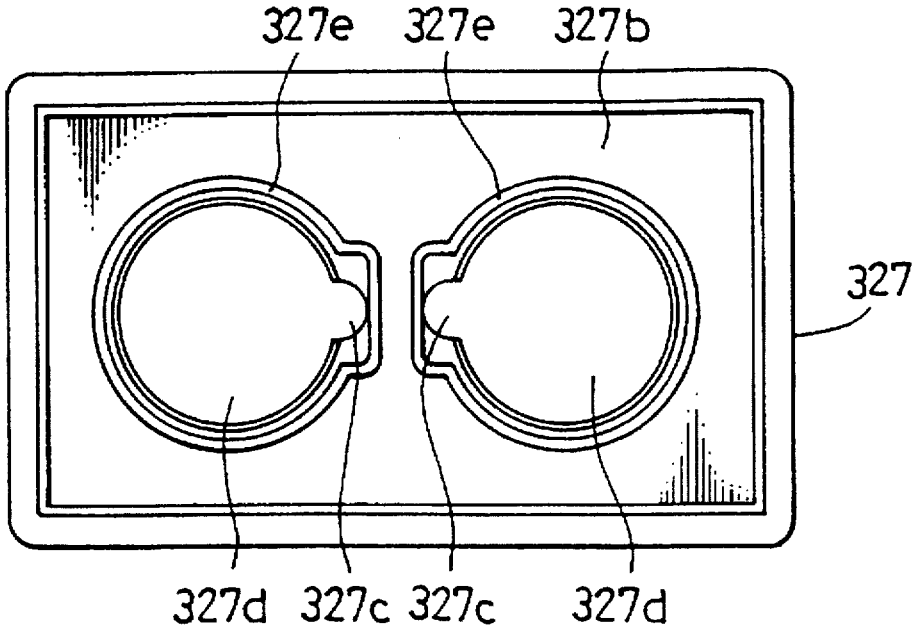
FIG. 31 is a top plan view of a housing case in the device shown in FIG. 29.
Figure 32:
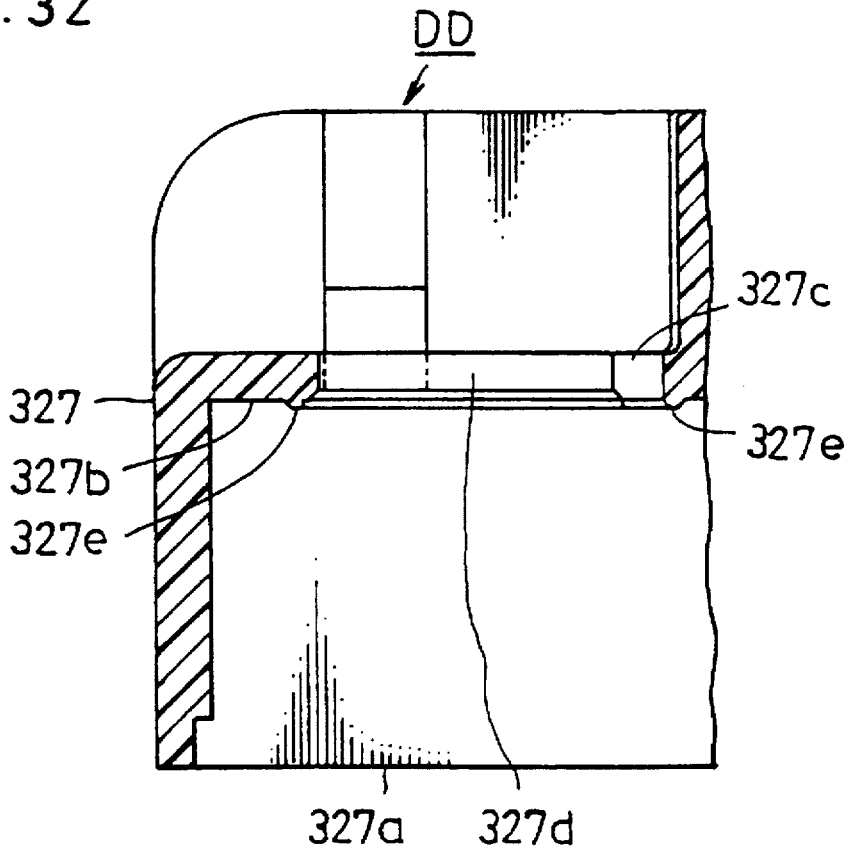
FIG. 32 is a fragmentary sectioned view of the housing cage in the device shown in FIG. 29.

Next, when it is required to mechanically restrain the operation of the movable member 12 in the driving member BB for preventing the contacts from closing, the lock lever 200 is pushed inward so that the tip end of the lock lever 200 will enter further into the interior of the housing, and the lever 200 is locked to a position different from the foregoing locked position. The movable space for the movable member 12 is thus occupied by the lock lever 200 depending on the extent of the pushing-in, the movable member 12 cannot be allowed to displace by an initially set extent even upon application of the input signals (actuation of the electromagnetic device), and the contacts in the contact section AA are also made unable to be closed. Details of locking means and resetting means shall be referred to later. Entire arrangement of this sealed contact device is shown in FIG. 28.

Figure 16:
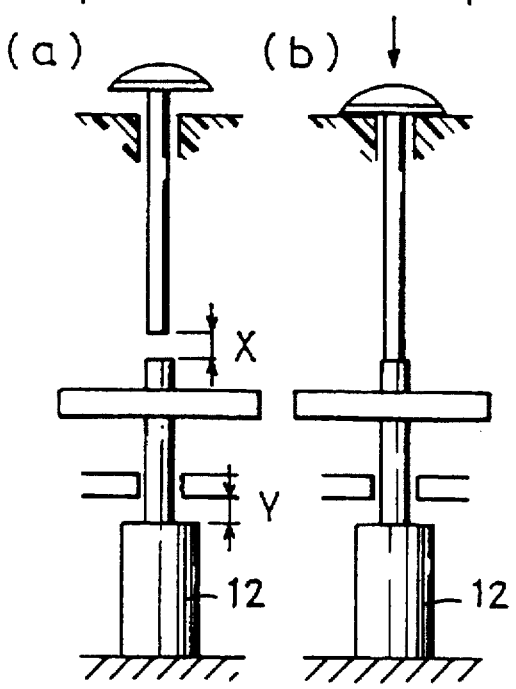
FIGS. 16(*a*) and 16(*b*) are schematic explanatory views for the operation of the device in FIG. 15.

In FIG. 16, one of working aspects is shown, with an illustration of the operation of the movable member 12 in the movable space. In normal use of the contactors without the locking of the movable member 12 by the lock lever 200, their position relationship is as shown in FIG. 16(*a*), in which the movable space X for the movable member 12 is furnished with a space equal to or more than a stroke Y of the electromagnetic device. When the movable member 12 is locked, the positional relationship will be of FIG. 16(*b*), in which the lock lever 200 is pushed down to preliminarily occupy the movable space X.

Figure 17:
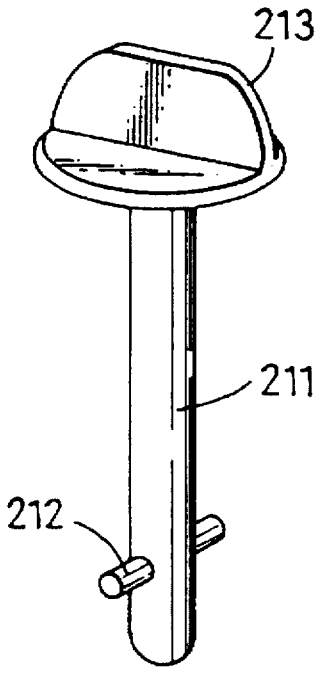
FIG. 17 shows in a perspective view an operating knob in the device shown in FIG. 15.
Figure 18:
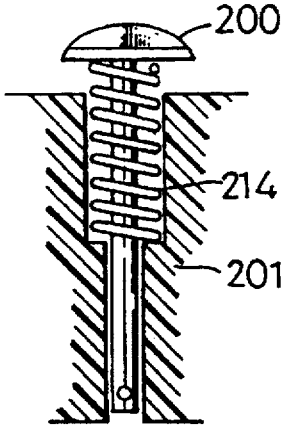
FIG. 18 is a side elevation of the operating knob employed in the device of FIG. 15.
Figure 19:
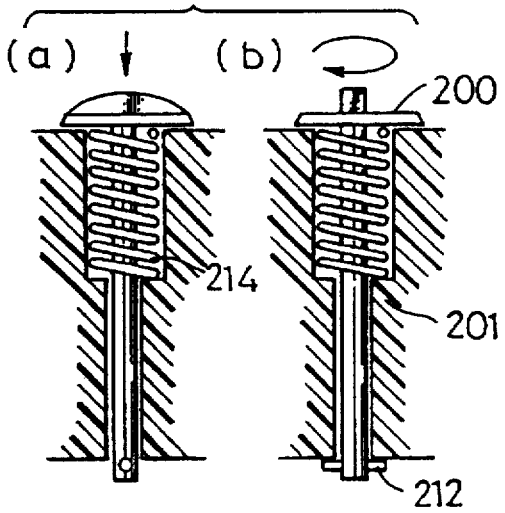
FIG. 19(*a*) and 19(*b*) are explanatory views for the operation of the device shown in FIG. 15.
Figure 20:
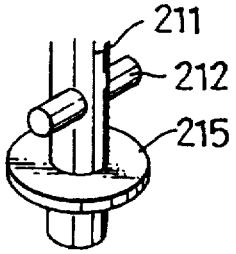
FIG. 20 is a fragmentary perspective view of the operating knob in another embodiment according to the present invention.
Figure 21A:
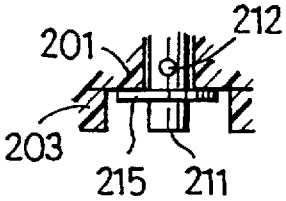
FIGS. 21A and 21B are explanatory views for the operation of the operating knob of FIG. 20.
Figure 21B:
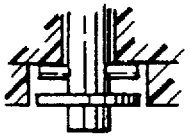

In FIGS. 17 and 18, there is shown a practical structure of the lock lever 200 in the foregoing embodiment, which comprises a shaft 211, locking pin 212, operating knob 213 and resetting spring 214 and is housed within the housing member 201 in the aspect of FIG. 18. Normally, a strong stress is applied by the electromagnetic device to the shaft 211, and this shaft 211 is formed by a metal excellent in the strength without deformation and also in the workability. In particular, non-magnetic stainless steels and the like will be optimum. Since similarly strong stress is applied to the locking pin 212, the metal shaft will be the optimum. As the operating knob 213 may only be rotated as pushed down, the strength needs not be made larger, and any insulating member (such as a molded article) will be the optimum from the view point of the safety and easiness of use. That is, the shape is optional but is manufactured into one capable of being rotated and pushed down by fingers. At this time, it is required to keep in mind that the rotary torque upon being rotated will be also made larger when the shape is made larger, and any damage to the housing member or the like must be prevented from occurring. The position of lower side surface of the operating knob 213 from the housing member 201 is so set that the knob can reach the top end face of the housing member 201 immediately before the timing when the shaft 211 reaches the movable member 12, whereby the movable member 12 is prevented from being pushed down more than required and a lower limit stopper is provided. The resetting spring 214 is mounted on the shaft 211 prior to a fixing of the locking pin 212 to the shaft 211 as urged or calked into a pin hole of the shaft, thereafter the locking pin 212 is fixed to the shaft 211, so as to be formed into a block, which block is inserted into a hole made in the housing member 201 from above. This hole of the housing member 201 is formed to have a portion allowing the shaft 211 and locking pin 212 to pass therethrough, and a wider portion for receiving the resetting spring 214 while providing a step for compressing the spring by a predetermined extent. In normal unlocking state of the lock lever 200, the lower face of the operating knob 213 is disposed at a position higher than the top face of the housing member 201 due to the resetting force of the resetting spring 214 and, for locking the lever 200 to this position, the shaft 211 is provided with the locking pin 212 or another stopper means 215 of an optimum arrangement, so that the locking lever 200 will be stopped at a predetermined position. The locked state is attained in such manner as follows, and as shown in FIGS. 19(*a*) and (*b*). Initially, the operating knob 213 is manually pushed down until the lower side face of the knob 213 engages the top face of the housing member 201, upon which the tip end of the shaft 211 and locking pin 212 are positioned inside the foregoing movable space of the movable member 12. Then, the knob 213 is rotated from this state for a half rotation, for example, upon which the locking pin 212 is caused to engage with the lower side face of the housing member 201 or 203, and the locking lever 200 is locked again to its lower position different from the foregoing unlock state, resisting against the resetting force of the resetting spring 214. In FIG. 20, a practical aspect of the locking means is shown. A stopping of upward escaping of the shaft 211 in the lock state is achieved by the locking pin 212, but this pin 212 is located inside the hole of the housing member 201 in the unlock state, and, instead, a stop ring as another stopper means 215 acts a roll of locking the lever 200 with respect to the housing. This stop ring 215 may be such one available in the market as an E-ring or a C-ring, which is only required to bear against the resetting force of the resetting spring 214. In their assembling, the stop ring 215 is fitted from lateral side into a ring mounting groove (not shown) of the shaft 211 which groove being positioned below the lower face of the housing member 203 when the locking lever 200 is first urged sufficiently into the hole of the housing member 203, and is thus mounted to the shaft 211. There are shown in FIG. 21B the locked state with the stop ring 215 employed and, in FIG. 21A, the unlock state. The housing member 203 is provided with a hole for accommodating the stop ring 215.

Figure 22:
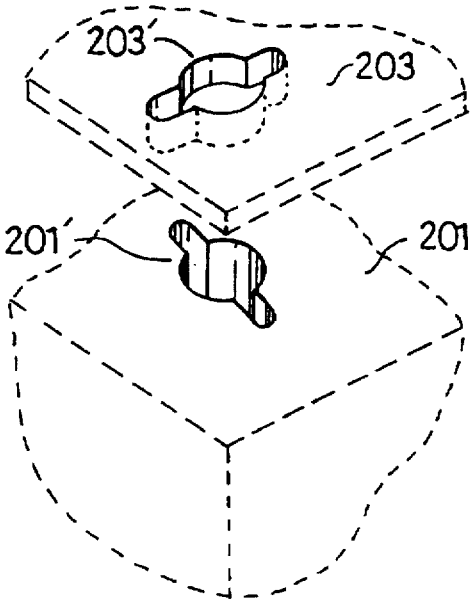
FIG. 22 is a fragmentary perspective view of the container employed in the device of another embodiment according to the present invention.
Figure 23A:
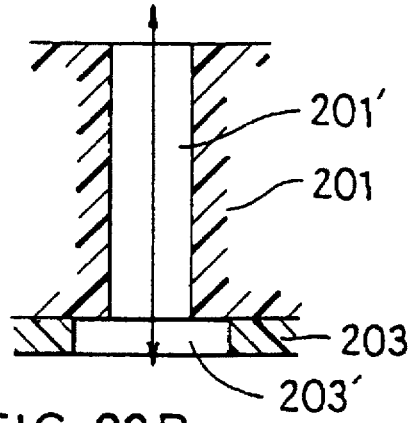
FIGS. 23A and 23B are fragmentary sectioned views taken at different angle positions of the device in FIG. 22.
Figure 23B:
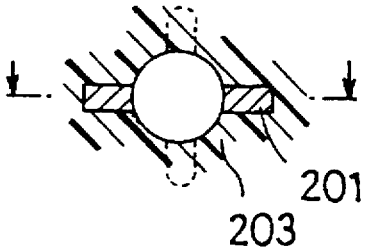

FIG. 22 shows another lock means for the lock lever 200 in an aspect of relying only on matching holes of the housing members without using the stop ring 215. The housing members 201 and 203 have planar joining surfaces, through which the matching holes 201' and 203' for receiving the lock lever 200, the holes matching in the direction perpendicular to the joining surfaces. These holes 201' and 203' respectively have diametrally opposing grooves for passing the locking pin 212 at the tip end of the lock lever 200, which grooves are mutually intersecting at right angles between the housing members 201 and 203. In FIGS. 23A and 23B, there are shown a vertically sectioned view and a cross sectioned view of the holes in the arrangement of FIG. 22.

It should be appreciated that the grooves for passing the locking pin 212 at the tip end of the lock lever 200 are lying in directions intersecting at right angles between the housing members 201 and 203. In assembling, the lock lever shaft 211 is not provided at the tip end with any other locking means than the lock pin 212, the lock lever 200 is pushed into the hole similarly to the case of the arrangement of FIGS. 18 and 19 and thereafter the lever is rotated by a corresponding extent to have the lever locked once to the bottom side surface of the housing member 201. When a shallow groove allowing the locking pin 212 to be temporarily placed is provided to the bottom side surface of the housing member 201, at this time, it becomes easier to determine the position of rotary matching upon the later joining of the housing member 201 with the housing member 203. Then, the housing member 203 is joined with the housing member 201, and they are so arranged that the locking pin 212 will be received in the pin receiving groove made in the housing member 203, whereby the locking lever 200 can be prevented from being caused to escape out of the housing member 201 due to the resetting force of the resetting spring 214. In locking the movable member 12, the locking lever 200 is further pushed into the hole and rotated by the corresponding extent so as to be locked to the bottom side surface of the housing member 203. Provided that, similarly to the housing member 201, a shallow groove allowing the locking pin 212 to be placed temporarily is provided in the bottom side surface of the housing member 203, the position of the manual rotary matching is made to be easily determined. In this case, a shift component in vertical direction of the locking pin 212 corresponds directly to the occupying component in the movable space for the movable member 12. In releasing the lock, the locking lever 200 is rotated to a required extent in reverse direction to the above, the locking pin 212 being locked as placed on the bottom side surface of the housing member 203 comes in alignment with the receiving hole 203' of the housing member 203, and the pin is caused by the resetting force of the resetting spring 214 to return along the hole to the bottom side surface of the housing member 201 to be locked thereon. Here, the locked position of the locking lever 200 is made to be one that does not give any influence on the normal operation of the movable member as has been referred to, whereby the locking pin 212 is assured to be always locked on the bottom side surface of the housing member 201 or 203.

Figure 24:
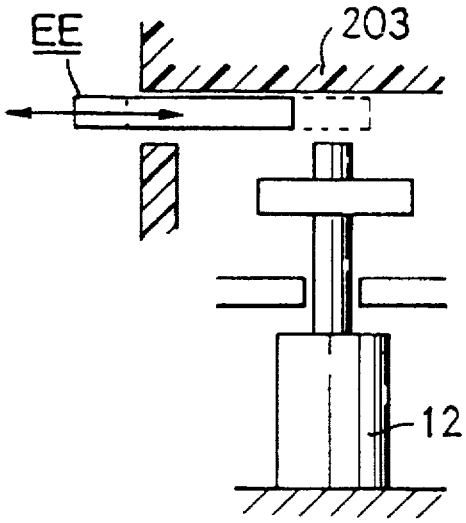
FIG. 24 is a schematic explanatory view for another embodiment according to the present invention.
Figure 25:
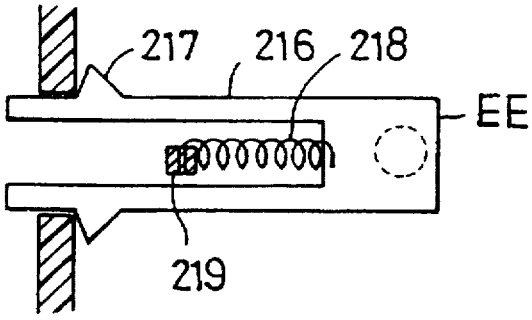
FIG. 25 is a schematic explanatory view for the operation of the device shown in FIG. 24.
Figures 27A, 27C:
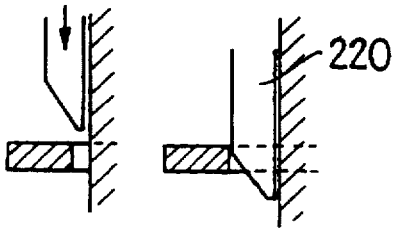
FIGS. 27A–27D is a schematic explanatory view for the operation of another embodiment of the device of FIG. 24.
Figures 27B, 27D:
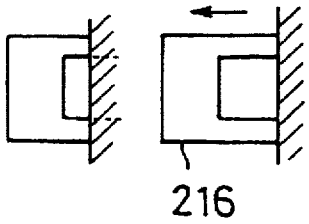
Figure 26:
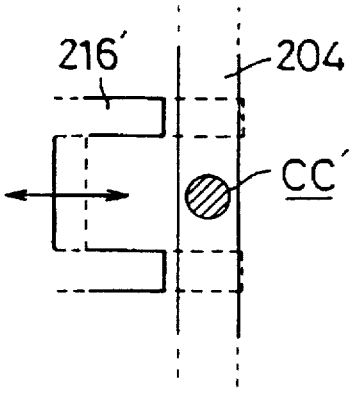
FIG. 26 is a schematic explanatory view for another embodiment of the device of FIG. 24.

In FIG. 24, there is shown the locking means in another embodiment of the present invention. The arrangement here is made to provide an insert groove for a locking lever EE in a lateral side wall of the housing member 203, so that a lateral displacement of the locking lever EE is utilized for occupying and controlling the vertical movable space for the movable member 12 in the driving member BB. Here, a space gap between contacting surfaces of the locking lever EE and the movable member 12 is more than zero and is required to be made less than the gap between both contacts being closed. In FIG. 25, there is shown a practical arrangement of the locking lever EE in this embodiment, which lever EE comprises a lever section 216 made by an insulating resin material, positioning projections 217 for locking the locking lever EE to the housing member, spring 218 as a resetting means, and a projection 219 from the housing member for holding an end of the spring. References to the operation at this An time will be as follows. In an event of normal use without locking the driving member, the positioning projections 217 are positioned on outer side of the housing member and held stationary in a state of being biased always towards the interior of the housing body by the resetting force of the resetting spring 218. At this time, tip ends of the lever section 216 are positioned not to reach the movable space for the movable member 12 of the driving member. Next, in locking the driving member, the lever is pushed into the housing member with the positioning projections 217 made to pass through the hole in lateral side wall of the housing member while holding the tip ends of the lever section 216 to render the positioning projections 217 to be capable of entering into the housing member. The tip ends of the lever section 216 are released and elastically restore the shape, while the positioning projections 217 are urged against the inner wall of the housing member by the resetting force of the spring 218 here acting to bias the entire lever EE towards the outer side of the housing member, as shown in FIG. 25. In FIG. 26, there is shown an arrangement basically the same as that referred to with reference to FIG. 25 but, here, having the movable shaft of the driving member and contact drive shaft disposed on the same axis by means of such arrangement as 1 make contact (1a). Because the movable space above the central shaft CC' of the movable member 12 is coupled in the top part, the arrangement for regulating the space at the position above the central shaft cannot be employed, and the movable space displacement of the molded lever 204 out of alignment with the central shaft CC' of the movable member is to be subjected to the regulation. At this time, the tip ends of the lever section 216 are modified in shape so as to be not engageable with the central shaft CC' but engageable with the molded lever 204 as shown by a numeral 216'. The locking operation and so on are the same as those in FIG. 25.

In FIGS. 27A–27D, there is shown another embodiment of the present invention, in which the basic arrangement comprising the lever section 216, resetting spring 218 and spring holding projection 219 is the same as the foregoing embodiment but the difference resides in that the lateral displacement of the lever section 216 is combined with a depressible lever 220 held preliminarily by the housing member. This depressible lever 220 is made lockable with respect to the housing member at predetermined upper and lower positions by a locking means, for displacing the lever section 216 in lateral direction. The respective aspects of FIGS. 25 and 27 are settable for attaining either the locking or the unlocking upon the puch-in, for example, of the lever section 216, by means of a combination of the tip end shape of the lever section 216 with the shape of the molded lever 204 of the movable member 12.

In FIGS. 29–32, there is shown another embodiment of the present invention, in which the sealed contact device generally comprises the sealed contact section AA, driving member BB and housing DD.

The sealed contact section AA includes the sealed container 301, which defines therein the gas-tight space by means of the container body 302 formed with such heat-resisting material as a ceramic material and in a box shape opened at one surface, the bellows 303 formed by the thin corrugated metal tube, the lid 304 made by the 42-alloy or the like and having the central through hole 304a and ventilation hole 304b at a proper portion, and the bellows holder 306 provided with the bearing 305, while the gas mainly consisting of hydrogen is charged therein through the ventilation hole 304b under about 2 atm., and the ventilation hole 304b is sealed after the charging. The planar insulating plate 307 made of such heat-resisting material as the ceramic material is fitted to inner side of the lid 304 for protecting the lid 304 against the arc.

The fixed electrodes 308 respectively made by a copper alloy material substantially in the columnar shape are secured to the sealed container 301 by means of soldering or the like at their locally large-diametered central parts 308c through a securing member 309 made of 42-alloy or the like, in the state where their one ends 308b carrying the fixed contacts 308a secured are positioned inside the sealed container 301. The fixed contacts 308a may be provided integrally with and by the same material as the fixed electrodes 308. Further, these fixed electrodes 308 are adhered at a portion adjacent to the central part 308c to the housing DD and sealed container 301, in a state where the other ends 308e forming the terminals 308d threaded and carrying nuts 310 and washers 311 passed are projected out of the sealed container 301, as will be detailed later.

The movable contactor 312 on the other hand is formed substantially in a planar shape by the copper alloy material, with a pair of the movable contacts 312a secured to both end parts at a space capable of engaging with and separating from the fixed contacts 308a. These movable contacts 312a may be provided integrally with and by the same material as the movable contactor 312. The movable shaft 313 is formed in a round bar, which is projected at one end 313a out of the sealed container 301 in the assembled state. This movable shaft 313 is supported at a portion adjacent to one end 313a by a bearing 305 and at a portion adjacent to the other end 313b by a bearing 314.

The contact pressure spring 315 is formed in a coil shape to have a slightly larger inner diameter than an outer diameter of a contact pressure spring frame 316 which is formed in a bottomed cylinder having at its opening a flange 316a and in the bottom a through hole, and the contact pressure spring frame 316 also performs a function of protecting the bellows 303. A movable contactor holder 317 is formed in a bifurcate shape disposing two leg parts on both sides of a central part having a through hole.

The foregoing movable shaft 313 is held as passed at the other end part 313b through the through holes made in the bottom of the contact pressure spring frame 316 and in the central part of the movable contactor holder 317. The contact pressure spring 315 is disposed as compressed between the movable contactor 312 and the flange 316a of the contact pressure spring frame 316, so that the movable contactor 312 is biased in the direction of engaging the movable contacts 312a with the fixed contacts 308a.

The resetting spring 318 is formed in a coil shape and is disposed to bias the movable contactor 312 in the direction of separating the movable contacts 312a from the fixed contacts 308a. A resetting spring frame 319 is formed in a bottomed cylinder shape with such heat-resisting material as a ceramic material and is disposed at a position adjacent to the contacts while enclosing the resetting spring 318.

A magnetic means (not shown) including the permanent magnet and a yoke holding the magnet is installed to outer surface of the container body 302 so that the yoke will enclose the fixed contacts 308a and movable contacts 312a. Consequently, a magnetic field is provided to the space where both contacts 308a and 312a exist, in a direction intersecting at right angles the operating direction of the movable contacts 312a.

Referring next to the driving member BB, the same is constituted by the electromagnetic device, in which the coils 320 are wound on the coil bobbin 321, the drive shaft 322 is combined with an insulating member and screwed at one end 322a to the movable core (not shown) movable in axial direction within the through hole of the coil bobbin 321 upon excitation of the coils 320, and the yoke 323 is formed to be U-shaped with a central part and both opposing parts for enclosing both axial ends of the coils 320. The drive shaft 322 is brought, when screwed to the movable core, into engagement with an end 313a of the movable shaft 313. The yoke plate 324 is fixed to the yoke 323. The stationary core 325 is fixed at one end to the center of the yoke 323, and has an axial hole 325a for inserting the drive shaft 322. The support springs 326 are arranged for supporting these members referred to.

Referring next to the housing DD, this housing is provided for concurrently housing the sealed contact section AA and driving member BB. The case 327 is formed substantially in the box shape having the opening 327a on one side, while the top-sided bottom part 327b is provided with a pair of through holes 327d respectively having locally recessed notches 327c so as to be a gourd shape. Along opening edges of these through holes 327d on the side of the opening 327a and as slightly outer side of the edges, circumferential projections 327*e* are provided. Capsule cushions 328 made by an elastic material are disposed between the case 327 and the sealed container 301 for absorbing any dimensional tolerance of the sealed container 301, in which disposition the cushion acts as an engaging part 329 with respect to the circumferential projection 327*e*. Further, the capsule cushion 328 is provided with gourd-shaped overlapping holes 328*e* corresponding to the through holes 327*d* of the case 327. The case body 330 is formed substantially in a rectangular tube shape having projections at diagonally opposing positions on the side of an open side and provided with holes 330*a* for installing. The interior of this case body 330 is divided by a central partition 330*b*, and the through hole 330*c* for passing the movable shaft 313 is made vertically through the partition 330*b* at its central position. The bottom plate 331 has screw holes 331*a* for passing the screws 332 to be screwed to the holes (not shown) other than the holes 330*a* of the case body 330.

Next, the sequence for securing the fixed electrodes 308 to the housing CC shall be referred to. The sealed container 301 is disposed within the case 327 of the housing CC, the fixed electrodes 308 projected out of the sealed container 301 are passed through the overlapping holes 328*e* of the capsule cushion 328 and the through holes 327*d* of the case 327 and, thereafter, an adhesive is pored through the notches 327*c* to achieve the securing. That is, an adhering part 333 is constituted between inner peripheries of the through holes 327*d* of the case 327 and outer peripheries of the central parts 308*c* of the fixed electrodes 308.

Referring next to the operation of this embodiment, the movable core is attracted to the stationary core 325 upon the excitation of the coils 320, then the drive 322 screwed to the movable core is moved to drive the one end 312*a* of the movable contactor 312 engage with the fixed contacts 308*a*.

As the excitation of the coils 320 is ceased, the movable contactor 312 is rest by the biasing force of the resetting spring 318 resisting against the contact pressure spring 315, and the movable contacts 312*a* are separated from the fixed contacts 308*a*, while the movable core is also reset by the predetermined distance to restore the original state until it collides with the support springs 326 to be restricted. The arc generated between the contacts upon the resetting is expanded sufficiently towards both ends of the movable contactor due to the magnetic field of the magnetic means and extinguished.

Now, since in the sealed contact device in the present embodiment the fixed electrodes respectively include as integralized the one end 308*b* carrying the fixed contact 308*a* and the other end 308*e* comprising the terminal 308*d*, it is made possible to reduce the number of required parts and, since the adhering part 333 for adhering the fixed electrode 308 causes the elastic engaging part 329 to be bent with the circumferential projection 327*e* provided to externally enclose the adhering part 333 when the sealed contact section AA is accommodated into the housing CC, it is possible to improve the adherency between the projection 327*e* and the engaging part 329 and to prevent the adhesive from exuding out of the projection 327*e*.

In the present embodiment, further, the capsule cushion 328 made of the elastic material is disposed to form the engaging part 329 with respect to the projection 327*e*, it is possible to form the projection 327*e* to have a thin tip end to be bendable. Further, when the projection 327*e* itself is prepared to have an elasticity by separately making the projection 327*e* with rubber and adhering it to the position, it will be no more necessary to provide the capsule cushion 328 as the engaging part 329.

What is claimed is:

1. A sealed contact device comprising;

a sealed contact section including a sealed container defining therein a gas-tight space together with a bellows for housing therein electrodes and sealing therein a gas, a fixed electrode, a movable electrode provided for engaging with and separating from said fixed electrode, a contact pressure spring for urging said movable electrode in a direction of engaging the movable electrode with the fixed electrode, a resetting spring for urging the movable electrode in a direction of separating the movable electrode from the fixed electrode, and a movable shaft projected at one end out of said sealed container and coupled at the other end to the movable electrode;

a driving member including a movable part for providing a drive force to said movable shaft of said sealed contact section; and a relaying member interposed between said movable shaft of said sealed contact section and said movable part of said driving member to transmit said drive force of the driving member to the movable shaft, said relaying member having means coupled to the movable shaft of the sealed contact section for regulating a drive force transmitting position with respect to the movable shaft;

wherein said relaying member is provided with a coupling element coupled at one portion to said movable part of said driving member and at another portion through said regulating means to said movable shaft of said sealed contact section.

2. The device according to claim 1, wherein said movable part of said driving member and said movable shaft of said sealed contact section are disposed to be coaxial, and said coupling element comprises a threaded element rotatable about said movable shaft as an axis.

3. A sealed contact device comprising;

a sealed container defining therein a gas-tight space together with a bellows for housing therein contacts and sealing therein a gas mainly consisting at least of hydrogen;

a pair of fixed electrodes respectively provided with a fixed contact;

a movable contactor provided with a pair of movable contacts respectively engaging with and separating from each of said fixed contacts;

a contact pressure spring biasing said movable contactor in a direction of engaging said movable contacts with said fixed contacts;

a resetting spring biasing said movable contactor in a direction of separating said movable contacts from said fixed contacts;

a receptacle provided on one side surface with a recess for receiving said resetting spring and disposed between said pair of fixed electrodes; and a movable shaft projected at an end out of said sealed container for being driven and coupled to said movable contactor;

wherein gaps are provided between said fixed electrodes and said receptacle.

4. The device according to claim 3, wherein said receptacle is provided with grooves on outer side of said recess on said one side surface.

5. A sealed contact device comprising;

a sealed container defining therein a gas-tight space together with a bellows for housing therein contacts and sealing therein a gas mainly consisting at least of hydrogen;

a pair of fixed electrodes respectively provided with a fixed contact;

a movable contactor provided on one side surface with a pair of movable contacts respectively engaging with and separating from each of said fixed contacts;

a contact pressure spring biasing said movable contactor in a direction of engaging said movable contacts with said fixed contacts;

a resetting spring biasing said movable contactor in a direction of separating said movable contacts from said fixed contacts;

a movable shaft projected at one end out of said sealed container for being driven and coupled to said movable contactor; and a regulating member fixed to said movable shaft for regulating the position of the movable contactor in said direction of engaging said movable contacts with said fixed contacts when both contacts are separated;

wherein said movable contactor is provided on one side surface with a recess for receiving said regulating member at least in substantially flush relationship to said surface.

6. A sealed contact device comprising;

a sealed contact section including a sealed container defining therein a gas-tight space together with a bellows for housing therein contacts and sealing therein a gas mainly consisting at least of hydrogen, a fixed electrode provided at one end with a fixed contact and having at the other end a terminal part integrally formed, a movable contactor provided with a movable contact engaged with and separated from said fixed contact, a contact pressure spring biasing said movable contactor in a direction of engaging said movable contact with said fixed contact, a resetting spring biasing said movable contactor in a direction of separating said movable contact from said fixed contact and a movable shaft projected at an end out of said sealed container and coupled to said movable contactor;

a driving member for driving said projected one end of said movable shaft to open and close said contacts; and a housing for housing therein said sealed contact section and driving member and provided with an adhering part for pouring therein said adhering element; wherein said housing is provided with a circumferential projection externally enclosing said adhering part, and with an engaging part having an elasticity and engaged with said projection when said sealed contact section is housed in the housing.

7. A sealed contact device comprising:

a sealed container defining therein a gas-tight space together with a bellows for housing therein contacts and sealing therein a gas mainly consisting at least of hydrogen;

a pair of fixed electrodes respectively provided with a fixed contact;

a movable contactor provided with a pair of movable contacts respectively engaged with and separated from each of said fixed contacts;

a contact pressure spring biasing said movable contactor in a direction of engaging said movable contacts with said fixed contacts;

a resetting spring biasing said movable contacts in a direction of separating said movable contacts from said fixed contacts;

a movable shaft projected at one end out of said sealed container for being driven and coupled to said movable contactor; and a housing for housing therein at least said pair of fixed electrodes, said movable contactor, said contact pressure spring, said resetting spring and said movable shaft;

wherein the device further comprises a locking means to be locked to said housing in a state of occupying a movable space defined for said movable shaft when displaced in a direction by a predetermined extent and including a resetting means for biasing said locking means to reset the locking means in a direction reverse to said displaced direction.

8. The device according to claim 7 wherein said locking means is displaced in the same direction as that of opening and closing respective said contacts.

9. The device according to claim 7 wherein said locking means is in a shaft shape and is disposed to be coaxial with said movable shaft.

10. The device according to claim 7 wherein said housing is formed to have means for preventing said locking means from escaping upon said resetting of the locking means by restricting said displacement to a fixed extent.

11. The device according to claim 7 wherein said displaced direction of said locking means intersects at right angles a plane in which constituting members of said housing are joined.

12. The device according to claim 7 wherein said displaced direction of said locking means intersects at right angles a direction in which said movable shaft displaces.

* * * * *